US008977541B2

(12) United States Patent
Toguri et al.

(10) Patent No.: US 8,977,541 B2
(45) Date of Patent: Mar. 10, 2015

(54) SPEECH PROCESSING APPARATUS, SPEECH PROCESSING METHOD AND PROGRAM

(75) Inventors: Yasuhiro Toguri, Kanagawa (JP); Shiro Suzuki, Kanagawa (JP); Jun Matsumoto, Kanagawa (JP); Yuuji Maeda, Tokyo (JP); Yuuki Matsumura, Saitama (JP)

(73) Assignee: Sony Corporation, Tokyo (JP)

( * ) Notice: Subject to any disclaimer, the term of this patent is extended or adjusted under 35 U.S.C. 154(b) by 355 days.

(21) Appl. No.: 13/583,839

(22) PCT Filed: Mar. 8, 2011

(86) PCT No.: PCT/JP2011/055293

§ 371 (c)(1),
(2), (4) Date: Sep. 10, 2012

(87) PCT Pub. No.: WO2011/114932

PCT Pub. Date: Sep. 22, 2011

(65) Prior Publication Data

US 2013/0006618 A1 Jan. 3, 2013

(30) Foreign Application Priority Data

Mar. 17, 2010 (JP) ..... 2010-061170

(51) Int. Cl.
*G10L 19/02* (2013.01)
*G10L 19/008* (2013.01)

(52) U.S. Cl.
CPC ..... *G10L 19/008* (2013.01); *G10L 19/0212* (2013.01)
USPC ..... 704/204

(58) Field of Classification Search
USPC ..... 704/200–204
See application file for complete search history.

(56) References Cited

U.S. PATENT DOCUMENTS 6,236,961 B1 * 5/2001 Ozawa ..... 704/221
2008/0249765 A1 * 10/2008 Schuijers ..... 704/203

(Continued)

FOREIGN PATENT DOCUMENTS

JP 2006-325162 11/2006
JP 2006-524832 11/2006

(Continued)

OTHER PUBLICATIONS

J. Engdegard, et al."Advanced Processing Based on a Complex-Exponential-Modulated Filterbank and Adaptive Time Signalling Methods", English-language abstract of corresponding international application No. PCT/EP2004/004607.

*Primary Examiner* — Abul Azad
(74) *Attorney, Agent, or Firm* — Finnegan, Henderson, Farabow, Garrett & Dunner, L.L.P.

(57) ABSTRACT

The present invention relates to a speech processing apparatus, a speech processing method and a program which, when multichannel audio signals are downmixed and coded, prevent delay and an increase in the computation amount upon decoding of the audio signals. An inverse multiplexing unit (101) acquires coded data on which a BC parameter is multiplexed. An uncorrelated frequency-time transform unit (102) performs IMDCT transform and IMDST transform of frequency spectrum coefficients of a monaural signal ($X_M$) obtained from this coded data to generate the monaural signal $X_M$) which is a time domain signal and a signal ($X_D$') which is substantially uncorrelated with this monaural signal ($X_M$). The stereo synthesis unit (103) generates a stereo signal by synthesizing the monaural signal ($X_M$) and the signal ($X_D$') using the BC parameter. The present invention is applicable to, for example, a speech processing apparatus which decodes a downmixed and coded stereo signal.

9 Claims, 17 Drawing Sheets

(56) References Cited

U.S. PATENT DOCUMENTS

| | | | | |
|---|---|---|---|---|
| 2010/0232619 | A1* | 9/2010 | Uhle et al. | 381/80 |
| 2010/0322429 | A1* | 12/2010 | Norvell et al. | 381/22 |

FOREIGN PATENT DOCUMENTS

| | | | |
|---|---|---|---|
| WO | WO 2007/010785 | A1 | 1/2007 |
| WO | WO 2007/029412 | A1 | 3/2007 |

* cited by examiner

SPEECH PROCESSING APPARATUS, SPEECH PROCESSING METHOD AND PROGRAM

TECHNICAL FIELD

The present invention relates to a speech processing apparatus, a speech processing method and a program and, more particularly, relates to a speech processing apparatus, a speech processing method and a program which, when multichannel audio signals are downmixed and coded, prevent delay and an increase in the computation amount upon decoding of the audio signals.

BACKGROUND ART

A coding apparatus which codes multichannel audio signals can perform highly efficient coding by utilizing a relationship between channels. This coding includes, for example, intensity coding, M/S stereo coding and spatial coding. A coding apparatus which performs spatial coding downmixes an n channel audio signal into a m (m<n) channel audio signal and codes the signal, finds spatial parameters representing the inter-channel relationship upon downmixing and transmits the spatial parameters together with the coded data. A decoding apparatus which receives the spatial parameters and the coded data decodes the coded data, and restores the original n channel audio signal from the m channel audio signal obtained as a result of decoding using the spatial parameter.

This spatial coding is known as "binaural cue coding". For the spatial parameters (hereinafter, referred to as "BC parameters"), for example, ILD (Inter-channel Level Difference), IPD (Inter-channel Phase Difference) and ICC (Inter-channel Correlation) are used. The ILD refers to a parameter indicating the ratio of the magnitude of an inter-channel signal. The IPD refers to a parameter indicating an inter-channel phase difference, and the ICC refers to a parameter indicating an inter-channel correlation.

FIG. 1 is a block diagram illustrating a configuration example of a coding apparatus which performs spatial coding.

In addition, n=2 and m=1 for ease of description. That is, a coding target audio signal is a stereo audio signal (hereinafter, referred to as "stereo signal"), and coded data obtained as a result of coding is coded data of a monaural audio signal (hereinafter, referred to as "monaural signal").

A coding apparatus 10 in FIG. 1 includes a channel donwmix unit 11, a spatial parameter detection unit 12, an audio signal coding unit 13 and a multiplexing unit 14. The coding apparatus 10 receives an input of a stereo signal including a left audio signal $X_L$ and a right audio signal $X_R$ as a coding target, and outputs coded data of a monaural signal.

More specifically, the channel downmix unit 11 of the coding apparatus 10 downmixes the stereo signal input as the coding target, to the monaural signal $X_M$. Further, the channel downmix unit 11 supplies the monaural signal to the spatial parameter detection unit 12 and the audio signal coding unit 13.

The spatial parameter detection unit 12 detects the BC parameters based on the monaural signal $X_M$ supplied from the channel downmix unit 11 and the stereo signal input as the coding target, and supplies the BC parameters to the multiplexing unit 14.

The audio signal coding unit 13 codes the monaural signal supplied from the channel downmix unit 11, and supplies resulting coded data to the multiplexing unit 14.

The multiplexing unit 14 multiplexes and outputs the coded data supplied from the audio signal coding unit 13 and the BC parameter supplied from the spatial parameter detection unit 12.

FIG. 2 is a block diagram illustrating a configuration example of the audio signal coding unit 13 in FIG. 1.

In addition, the audio signal coding unit 13 in FIG. 2 employs a configuration where the audio signal coding unit 13 performs coding according to, for example, MPEG-2 AAC LC (Moving Picture Experts Group phase 2 Advanced Audio Coding Low Complexity) profile. Meanwhile, the configuration is simplified and illustrated in FIG. 2 for ease of description.

The audio signal coding unit 13 in FIG. 2 includes a MDCT (Modified Discrete Cosine Transform) unit 21, a spectrum quantization unit 22, an entropy coding unit 23 and a multiplexing unit 24.

The MDCT unit 21 performs MDCT of the monaural signal supplied from the channel downmix unit 11, and transforms a monaural signal which is a time domain signal, into a MDCT coefficient which is a frequency domain coefficient. The MDCT unit 21 supplies the MDCT coefficient obtained as a result of transform, to the spectrum quantization unit 22 as a frequency spectrum coefficient.

The spectrum quantization unit 22 quantizes the frequency spectrum coefficient supplied from the MDCT unit 21, and supplies the frequency spectrum coefficient to the entropy coding unit 23. Further, the spectrum quantization unit 22 supplies quantization information which is information related to this quantization, to the multiplexing unit 24. The quantization information includes, for example, a scale factor and quantization bit information.

The entropy coding unit 23 performs entropy coding such as Huffman coding or arithmetic coding of the quantized frequency spectrum coefficient supplied from the spectrum quantization unit 22, and losslessly compresses the frequency spectrum coefficient. The entropy coding unit 23 supplies data obtained as a result of entropy coding, to the multiplexing unit 24.

The multiplexing unit 24 multiplexes the data supplied from the entropy coding unit 23 and the quantization information supplied from the spectrum quantization unit 22, and supplies resulting data to the multiplexing unit 14 (FIG. 1) as coded data.

FIG. 3 is a block diagram illustrating another configuration example of the audio signal coding unit 13 in FIG. 1.

In addition, the audio signal coding unit 13 in FIG. 3 employs a configuration of performing coding according to, for example, a MPEG-2 AAC SSR (Scalable Sample Rate) profile or MP3 (MPEG Audio Layer-3). Meanwhile, the configuration is simplified and illustrated in FIG. 3 for ease of description.

The audio signal coding unit 13 in FIG. 3 includes an analysis filter bank 31, MDCT units 32-1 to 32-N (N is an arbitrary integer), a spectrum quantization unit 33, an entropy coding unit 34 and a multiplexing unit 35.

The analysis filter bank 31 includes, for example, a QMF (Quadrature Mirror Filterbank) bank or a PQF (Poly-phase Quadrature Filter) bank. The analysis filter bank 31 divides the monaural signal supplied from the channel downmix unit 11, into N groups according to a frequency. The analysis filter bank 31 supplies N subband signals obtained as a result of division, to the MDCT units 32-1 to 32-N.

The MDCT units 32-1 to 32-N each perform MDCT of the subband signal supplied from the analysis filter bank 31, and transforms the subband signal which is a time domain signal, into a MDCT coefficient which is a frequency domain coefficient. Further, the MDCT units 32-1 to 32-N each supply the MDCT coefficient of each subband signal to the spectrum quantization unit 33 as the frequency spectrum coefficient.

The spectrum quantization unit 33 quantizes each of the N frequency spectrum coefficients supplied from the MDCT units 32-1 to 32-N, and supplies the N frequency spectrum coefficients to the entropy coding unit 34. Further, the spectrum quantization unit 33 supplies quantization information about this quantization, to the multiplexing unit 35.

The entropy coding unit 34 performs entropy coding such as Huffman coding or arithmetic coding of each of the quantized N frequency spectrum coefficients supplied from the spectrum quantization unit 33, and losslessly compresses the N frequency spectrum coefficients. The entropy coding unit 34 supplies N items of data obtained as a result of entropy coding, to the multiplexing unit 35.

The multiplexing unit 35 multiplexes the N items of data supplied from the entropy coding unit 34 and the quantization information supplied from the spectrum quantization unit 33, and supplies resulting data to the multiplexing unit 14 (FIG. 1) as coded data.

FIG. 4 is a block diagram illustrating a configuration example of a decoding apparatus which decodes coded data which is spatially coded by the coding apparatus 10 in FIG. 1.

A decoding apparatus 40 in FIG. 4 includes an inverse multiplexing unit 41, an audio signal decoding unit 42, a generation parameter calculation unit 43 and a stereo signal generation unit 44. The decoding apparatus 40 decodes the coded data supplied from the coding apparatus in FIG. 1, and generates a stereo signal.

More specifically, the inverse multiplexing unit 41 of the decoding apparatus 40 inversely multiplexes the multiplexed coded data supplied from the coding apparatus 10 in FIG. 1, and obtains the coded data and the BC parameter. The inverse multiplexing unit 41 supplies the coded data to the audio signal decoding unit 42, and supplies the BC parameter to the generation parameter calculation unit 43.

The audio signal decoding unit 42 decodes the coded data supplied from the inverse multiplexing unit 41, and supplies the resulting monaural signal $X_M$ which is a time domain signal, to the stereo signal generation unit 44.

The generation parameter calculation unit 43 calculates generation parameters which are parameters for generating a stereo signal from a monaural signal which is a decoding result of the multiplexed coded data, using the BC parameter supplied from the inverse multiplexing unit 41. The generation parameter calculation unit 43 supplies these generation parameters to the stereo signal generation unit 44.

The stereo signal generation unit 44 generates the left audio signal $X_L$ and the right audio signal $X_R$ from the monaural signal $X_M$ supplied from the audio signal decoding unit 42 using the generation parameters supplied from the generation parameter calculation unit 43. The stereo signal generation unit 44 outputs the left audio signal $X_L$ and the right audio signal $X_R$ as stereo signals.

FIG. 5 is a block diagram illustrating a configuration example of the audio signal decoding unit 42 in FIG. 4.

In addition, the audio signal decoding unit 42 in FIG. 5 employs a configuration where coded data coded according to, for example, the MPEG-2 AAC LC profile is input to the decoding apparatus 40. That is, the audio signal decoding unit 42 in FIG. 5 decodes the coded data coded by the audio signal coding unit 13 in FIG. 2.

The audio signal decoding unit 42 in FIG. 5 includes an inverse multiplexing unit 51, an entropy decoding unit 52, a spectrum inverse quantization unit 53 and an IMDCT unit 54.

The inverse multiplexing unit 51 inversely multiplexes the coded data supplied from the inverse multiplexing unit 41 in FIG. 4, and obtains the quantized and entropy-coded frequency spectrum coefficient and the quantization information. The inverse multiplexing unit 51 supplies the quantized and entropy-coded frequency spectrum coefficient to the entropy decoding unit 52, and supplies the quantization information to the spectrum inverse quantization unit 53.

The entropy decoding unit 52 performs entropy decoding such as Huffman decoding or arithmetic decoding of the frequency spectrum coefficient supplied from the inverse multiplexing unit 51, and restores the quantized frequency spectrum coefficient. The entropy decoding unit 52 supplies this frequency spectrum coefficient to the spectrum inverse quantization unit 53.

The spectrum inverse quantization unit 53 inversely quantizes the quantized frequency spectrum coefficient supplied from the entropy decoding unit 52 based on the quantization information supplied from the inverse multiplexing unit 51, and restores the frequency spectrum coefficient. Further, the spectrum inverse quantization unit 53 supplies the frequency spectrum coefficient to the IMDCT (Inverse MDCT) (Inverse Modified Discrete Cosine Transform) unit 54.

The IMDCT unit 54 performs IMDCT of the frequency spectrum coefficient supplied from the spectrum inverse quantization unit 53, and transforms the frequency spectrum coefficient into the monaural signal $X_M$ which is a time domain signal. The IMDCT unit 54 supplies this monaural signal $X_M$ to the stereo signal generation unit 44 (FIG. 4).

FIG. 6 is a block diagram illustrating another configuration example of the audio signal decoding unit 42 in FIG. 4.

In addition, the audio signal decoding unit 42 in FIG. 6 employs a configuration where coded data coded according to, for example, the MPEG-2 AAC SSR profile or a method such as MP3 is input to the decoding apparatus 40. That is, the audio signal decoding unit 42 in FIG. 6 decodes the coded data coded by the audio signal coding unit 13 in FIG. 3.

The audio signal decoding unit 42 in FIG. 6 includes an inverse multiplexing unit 61, an entropy decoding unit 62, a spectrum inverse quantization unit 63, IMDCT units 64-1 to 64-N and a synthesis filter bank 65.

The inverse multiplexing unit 61 inversely multiplexes the coded data supplied from the inverse multiplexing unit 41 in FIG. 4, and obtains the quantized and entropy-coded frequency spectrum coefficients of the N subband signals and the quantization information. The inverse multiplexing unit 61 supplies the quantized and entropy-coded frequency spectrum coefficients of the N subband signals to the entropy decoding unit 62, and supplies the quantization information to the spectrum inverse quantization unit 63.

The entropy decoding unit 62 performs entropy decoding such Huffman decoding or arithmetic decoding of the frequency spectrum coefficients of the N subband signals supplied from the inverse multiplexing unit 61, and supplies the frequency spectrum coefficients to the spectrum inverse quantization unit 63.

The spectrum inverse quantization unit 63 inversely quantizes each of the frequency spectrum coefficients of the N subband signals which are supplied from the entropy decoding unit 62 and which are obtained as a result of entropy decoding, based on the quantization information supplied from the inverse multiplexing unit 61. By this means, the frequency spectrum coefficients of the N subband signals are restored. The spectrum inverse quantization unit 63 supplies the restored frequency spectrum coefficients of the N subband signals to the IMDCT units 64-1 to 64-N one by one.

The IMDCT units 64-1 to 64-N each perform IMDCT of the frequency spectrum coefficient supplied from the spectrum inverse quantization unit 63, and transform the frequency spectrum coefficient into a subband signal which is a time domain signal. The IMDCT units 64-1 to 64-N each supply the subband signal obtained as a result of transform, to the synthesis filter bank 65.

The synthesis filter bank 65 includes, for example, an inverse PQF and an inverse QMF. The synthesis bank 65 synthesizes the N subband signals supplied from the IMDCT units 64-1 to 64-N, and supplies the resulting signal to the stereo signal generation unit 44 (FIG. 4) as the monaural signal $X_M$.

FIG. 7 is a block diagram illustrating a configuration example of the stereo signal generation unit 44 in FIG. 4.

The stereo signal generation unit 44 in FIG. 7 includes a reverb signal generation unit 71 and a stereo synthesis unit 72.

The reverb signal generation unit 71 generates a signal $X_D$ which is uncorrelated with this monaural signal $X_M$ using the monaural signal $X_M$ supplied from the audio signal decoding unit 42 in FIG. 4. For the reverb signal generation unit 71, a comb filter or an all pass filter is generally used. In this case, the reverb signal generation unit 71 generates a reverb signal of the monaural signal $X_M$ as the signal $X_D$.

In addition, for the reverb signal generation unit 71, a feedback delay network (FDN) is used in some cases (see, for example, Patent Document 1).

The reverb signal generation unit 71 supplies the generated signal $X_D$ to the stereo synthesis unit 72.

The stereo synthesis unit 72 synthesizes the monaural signal $X_M$ supplied from the audio signal decoding unit 42 in FIG. 4 and the signal $X_D$ supplied from the reverb signal generation unit 71 using the generation parameters supplied from the generation parameter calculation unit 43 in FIG. 4. Further, the stereo synthesis unit 72 outputs the left audio signal $X_L$ and the right audio signal $X_R$ obtained as a result of synthesis as stereo signals.

FIG. 8 is a block diagram illustrating another configuration example of the stereo signal generation unit 44 in FIG. 4.

The stereo signal generation unit 44 in FIG. 8 includes an analysis filter bank 81, subband stereo signal generation units 82-1 to 82-P (P is an arbitrary number) and a synthesis filter bank 83.

In addition, when the stereo signal generation unit 44 in FIG. 4 employs the configuration illustrated in FIG. 8, the spatial parameter detection unit 12 of the coding apparatus 10 in FIG. 1 detects the BC parameter per subband signal.

More specifically, for example, the spatial parameter detection unit 12 has two analysis filter banks. Further, in the spatial parameter detection unit 12, one analysis filter bank divides the stereo signal according to a frequency, and the other analysis filter bank divides the monaural signal from the channel downmix unit 11 according to a frequency. The spatial parameter detection unit 12 detects the BC parameter per subband signal based on the subband signal of the stereo signal and the subband signal of the monaural signal obtained as a result of division. Further, the generation parameter calculation unit 43 in FIG. 4 receives a supply of the BC parameter of each subband signal from the inverse multiplexing unit 41, and generates generation parameters per subband signal.

The analysis filter bank 81 includes, for example, a QMF (Quadrature Mirror Filter) bank. The analysis filter bank 81 divides the monaural signal $X_M$ supplied from the audio signal decoding unit 42 in FIG. 4 into P groups according to a frequency. The analysis filter bank 81 supplies P subband signals obtained as a result of division, to the subband stereo signal generation units 82-1 to 82-P.

The subband stereo signal generation units 82-1 to 82-P each include a reverb signal generation unit and a stereo synthesis unit. The configuration of each of the subband stereo signal generation units 82-1 to 82-P is the same, and therefore only the subband stereo signal generation unit 82-B will be described.

The subband stereo signal generation unit 82-B includes a reverb signal generation unit 91 and a stereo synthesis unit 92. The reverb signal generation unit 91 generates a signal $X_D^B$ which is irrelevant to this subband signal $X_m^B$ using the subband signal $X_m^B$ of the monaural signal supplied from the analysis filter bank 81, and supplies the signal $X_D^B$ to the stereo synthesis unit 92.

The stereo synthesis unit 92 synthesizes the subband signal $X_m^B$ supplied from the analysis filter bank 81 and the signal $X_D^B$ supplied from the reverb signal generation unit 91 using the generation parameters of the subband signal $X_m^B$ supplied from the generation parameter calculation unit 43 in FIG. 4. Further, the stereo synthesis unit 92 supplies the left audio signal $X_L^B$ and the right audio signal $X_R^B$ obtained as a result of synthesis, to the synthesis filter bank 83 as subband signals of the stereo signals.

The synthesis filter bank 83 synthesizes left and right stereo signals of each subband signal supplied from the subband stereo signal generation units 82-1 to 82-P at a time. The synthesis filter bank 83 outputs the resulting left audio signal $X_L$ and right audio signal $X_R$ as stereo signals.

In addition, the configuration of the stereo signal generation unit 44 in FIG. 8 is disclosed, in for example, Patent Document 2.

Further, a coding apparatus which performs intensity coding mixes the frequency spectrum coefficient of each channel at a frequency equal to or more than a predetermined frequency band of the input stereo signal, and generates the frequency spectrum coefficient of the monaural signal. Further, the coding apparatus outputs a level ratio of the frequency spectrum coefficient of this monaural signal and an inter-channel frequency spectrum coefficient as a coding result.

More specifically, the coding apparatus which performs intensity coding performs MDCT with respect to the stereo signal, and mixes and shares the frequency spectrum coefficient of each channel at a frequency equal to or more than a predetermined frequency band among resulting frequency spectrum coefficients of channels. Further, the coding apparatus which performs intensity coding quantizes and entropy-codes the shared frequency spectrum coefficient, and multiplexes resulting data and quantization information as coded data. Furthermore, the coding apparatus which performs intensity coding finds the level ratio of the inter-channel frequency spectrum coefficients, and multiplexes and outputs the level ratio and the coded data.

Still further, a decoding apparatus which performs intensity decoding inversely multiplexes the coded data on which the level ratio of the inter-channel frequency spectrum coefficients is multiplexed, entropy-decodes resulting coded data and inversely quantizes the coded data based on the quantization information. Moreover, the decoding apparatus which performs intensity decoding restores the frequency spectrum coefficient of each channel based on the level ratio of the frequency spectrum coefficient obtained as a result of inverse quantization and the inter-channel frequency spectrum coefficients multiplexed on the coded data. Moreover, the decoding apparatus which performs intensity decoding performs IMDCT of the restored frequency spectrum coefficient of each channel, and obtains a stereo signal at a frequency equal to or more than a predetermined frequency band.

Although such intensity coding ratio is usually used to improve a coding efficiency, a high band frequency spectrum coefficient of a stereo signal is monaural-coded and represented only by an inter-channel level difference, and therefore the original stereophonic effect is slightly lost.

CITATION LIST

Patent Documents

Patent Document 1: Japanese Patent Application Laid-Open No. 2006-325162

Patent Document 2: Japanese Patent Application Laid-Open No. 2006-524832

SUMMARY OF THE INVENTION

Problems to Be Solved By the Invention

As described above, the decoding apparatus 40 which decodes conventional spatially coded data generates the signal $X_D$ and signals $X_D^1$ to $X_D^P$ which are irrelevant to the monaural signal $X_M$ used upon generation of a stereo signal, using the monaural signal $X_M$ which is a time domain signal.

Therefore, the reverb signal generation unit 71 which generates the signal $X_D$, and the analysis filter bank 81 and the reverb signal generation units 91 of the subband stereo signal generation units 82-1 to 82-P which generate the signals $X_D^1$ to $X_D^P$ cause delay, and increases algorithm delay of the decoding apparatus 40. This causes a problem when, for example, the decoding apparatus 40 is requested to provide immediate response performance or the decoding apparatus 40 is used in real-time communication, that is, when low delay property is important.

Further, filter computation in the reverb signal generation unit 71, and the analysis filter bank 81 and the reverb signal generation units 91 of the subband stereo signal generation units 82-1 to 82-P increases the computation amount, and also increases the required buffer capacity.

In light of such a situation, the present invention can prevent delay and an increase in the computation amount upon decoding of audio signals when multichannel audio signals are downmixed and coded.

Solutions to Problems

A speech processing apparatus according to an aspect of the present invention includes: an acquisition unit which acquires frequency domain coefficients of speech signals of channels which are generated from speech signals which are speech time domain signals of a plurality of channels, and the number of which is less than a plurality of channels, and a parameter representing a relationship between the plurality of channels; a first transform unit which transforms the frequency domain coefficients acquired by the acquisition unit, into first time domain signals; a second transform unit which transforms the frequency domain coefficients acquired by the acquisition unit, into second time domain signals; and a synthesis unit which generates the speech signals of the plurality of channels by synthesizing the first time domain signals and the second time domain signals using the parameter, wherein a base of transform performed by the first transform unit and a base of transform performed by the second transform unit are orthogonal.

A speech processing method and a program according to an aspect of the present invention support a speech processing apparatus according to an aspect of the present invention.

According to an aspect of the present invention, frequency domain coefficients of speech signals of channels which are generated from speech signals which are speech time domain signals of a plurality of channels, and the number of which is less than a plurality of channels, and a parameter representing a relationship between the plurality of channels are acquired, the acquired frequency domain coefficients are transformed into first time domain signals, the acquired frequency domain coefficients are transformed into second time domain signals, and the speech signals of the plurality of channels are generated by synthesizing the first time domain signals and the second time domain signals using the parameter. In addition, a base of transform into the first time domain signals and a base of transform into the second time domain signals are orthogonal.

The speech processing apparatus according to an aspect of the present invention may be an independent apparatus or may be an internal block which forms one apparatus.

Effects of the Invention

According to an aspect of the present invention, it is possible to prevent delay and an increase in the computation amount upon decoding of audio signals when multichannel audio signals are downmixed and coded.

MODE FOR CARRYING OUT THE INVENTION

First Embodiment

Figure 9:
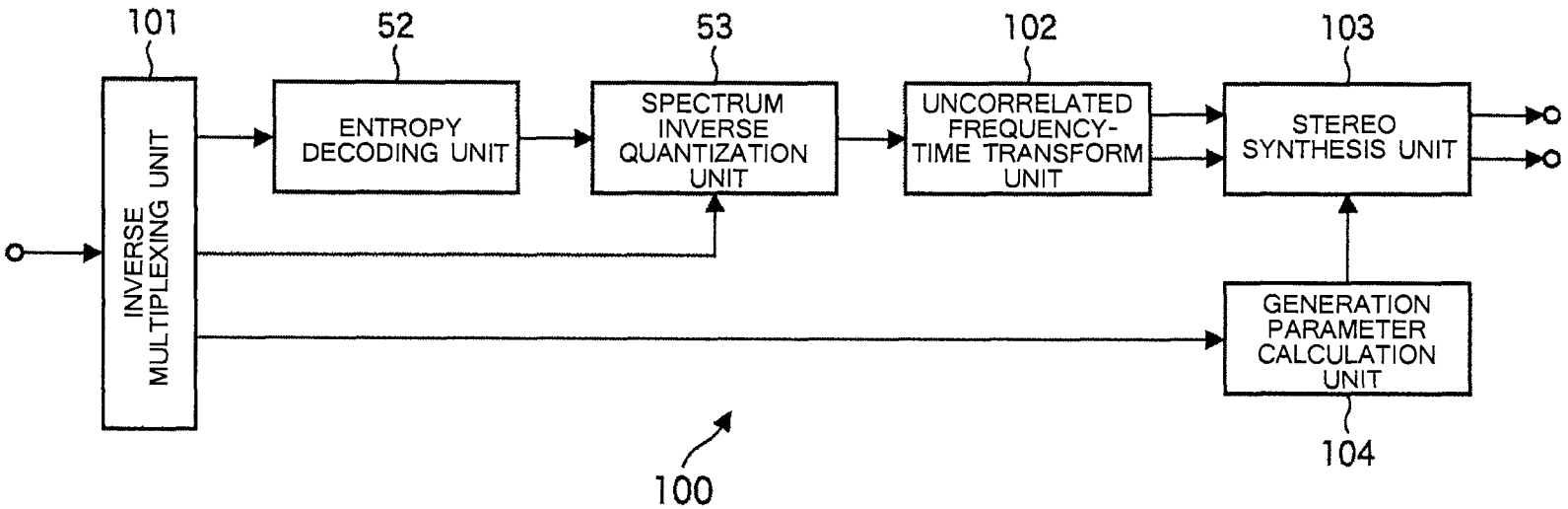
FIG. 9 is a block diagram illustrating a configuration example of a speech processing apparatus to which the present invention is applied according to a first embodiment.

Configuration Example of Speech Processing Apparatus According to First Embodiment FIG. 9 is a block diagram illustrating a configuration example of a speech processing apparatus to which the present invention is applied according to a first embodiment.

Figure 4:
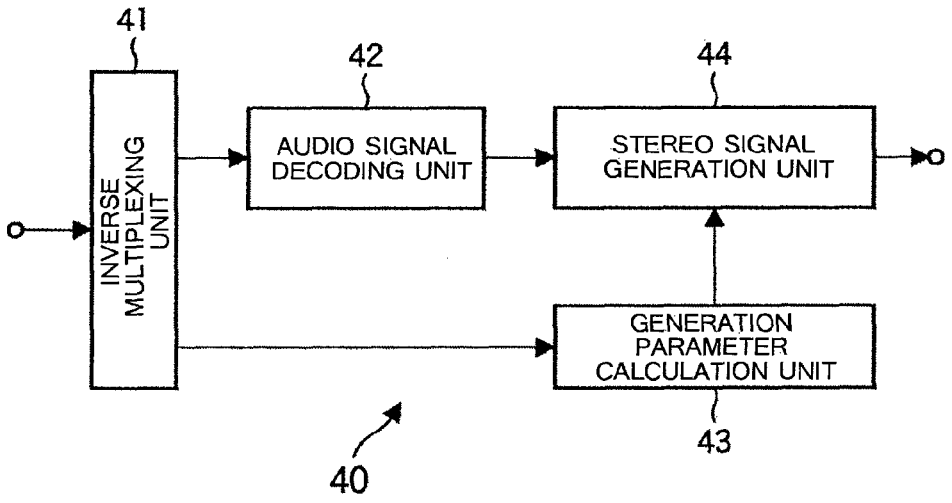
FIG. 4 is a block diagram illustrating a configuration example of a decoding apparatus which decodes spatially coded data.
Figure 5:
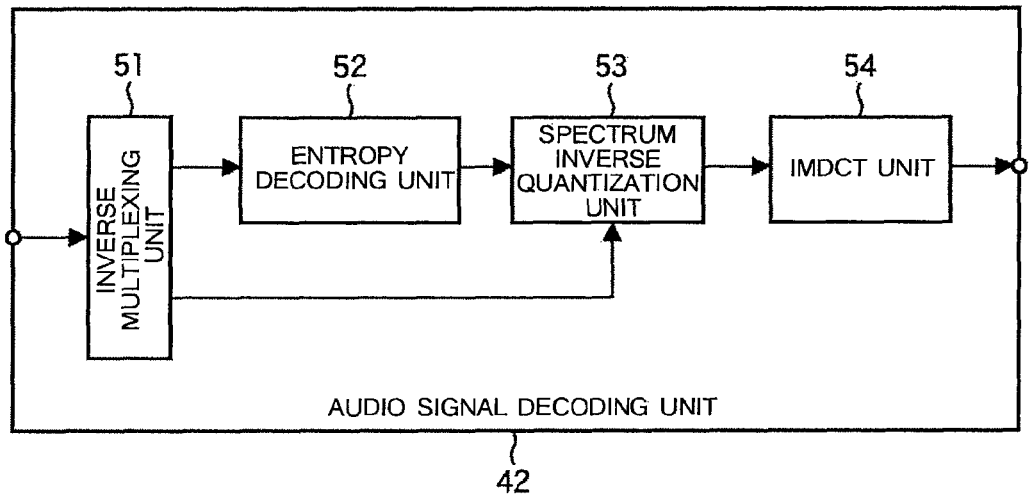
FIG. 5 is a block diagram illustrating a configuration example of an audio signal decoding unit in FIG. 4.

The same configuration illustrated in FIG. 9 as configurations illustrated in FIGS. 4 and 5 will be assigned the same reference numerals. Overlapping description will be adequately skipped.

Figure 7:
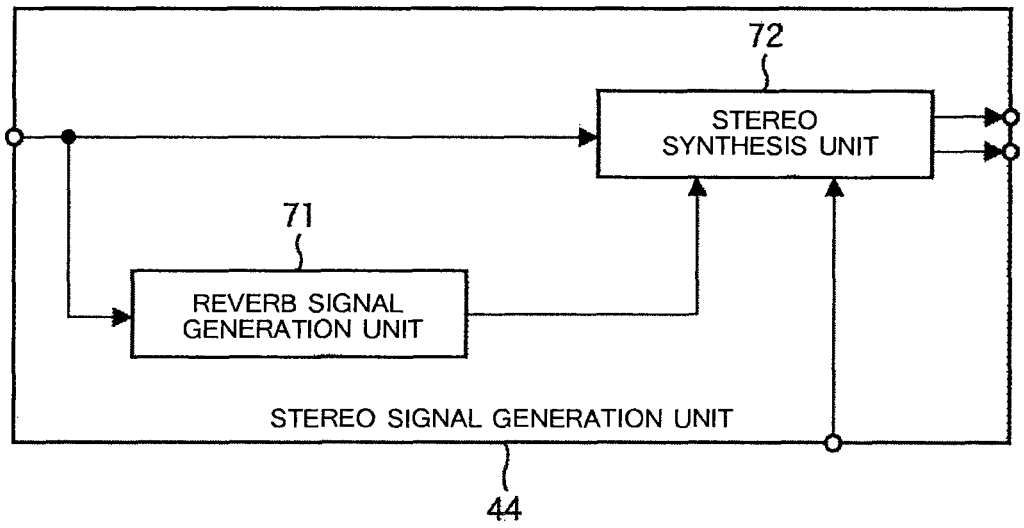
FIG. 7 is a block diagram illustrating a configuration example of a stereo signal generation unit in FIG. 4.
Figure 8:
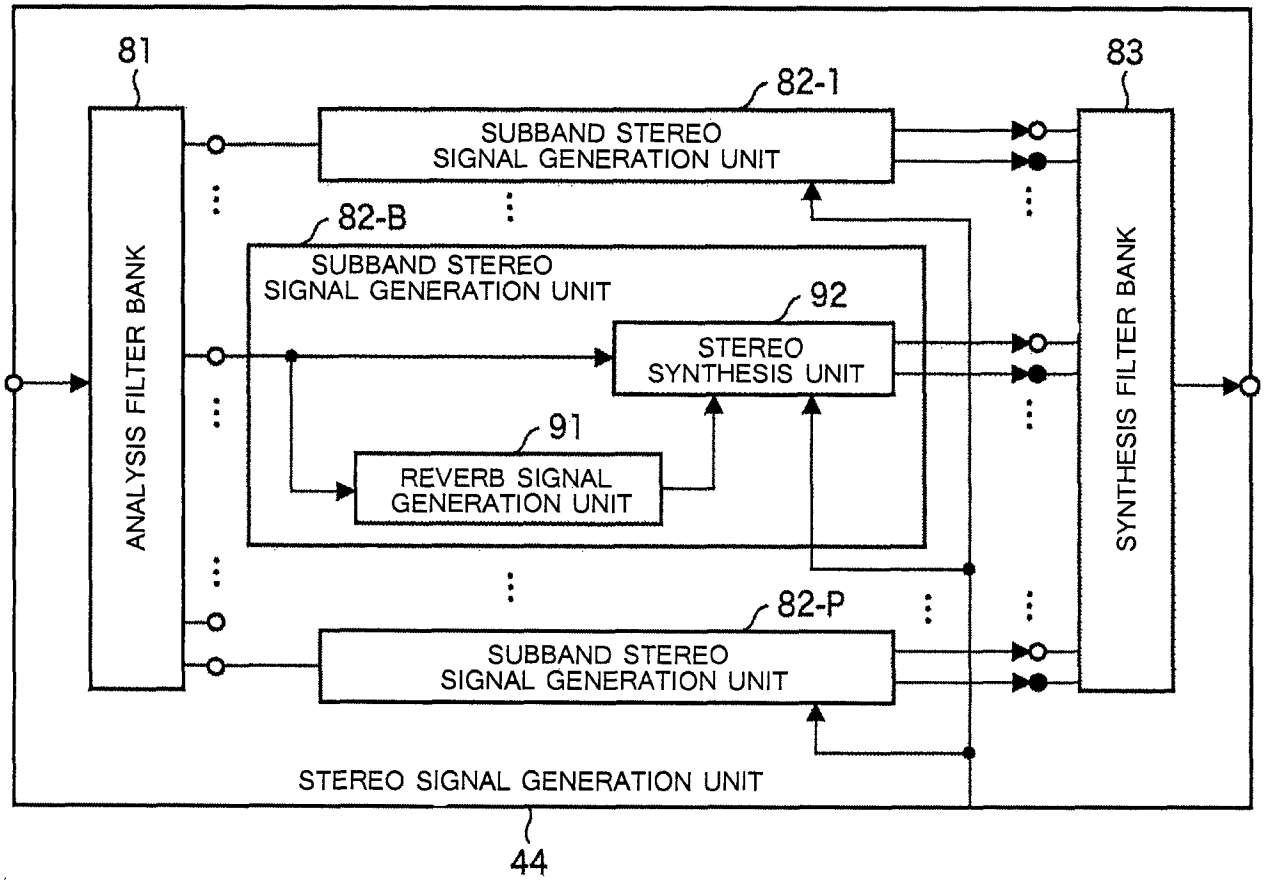
FIG. 8 is a block diagram illustrating another configuration example of the stereo signal generation unit in FIG. 4.

The configuration of the speech processing apparatus 100 in FIG. 9 differs from the configuration of a decoding apparatus 40 in FIG. 4 which has an audio signal decoding unit 42 in FIG. 5 and a stereo signal generation unit 44 in FIG. 7 mainly in that an inverse multiplexing unit 101 is provided instead of an inverse multiplexing unit 41 and an inverse multiplexing unit 51, an uncorrelated frequency-time transform unit 102 is provided instead of an IMDCT unit 54 and a reverb signal generation unit 71, and a stereo synthesis unit 103 and a generation parameter calculation unit 104 are provided instead of a stereo synthesis unit 72 and a generation parameter calculation unit 43.

Figure 1:
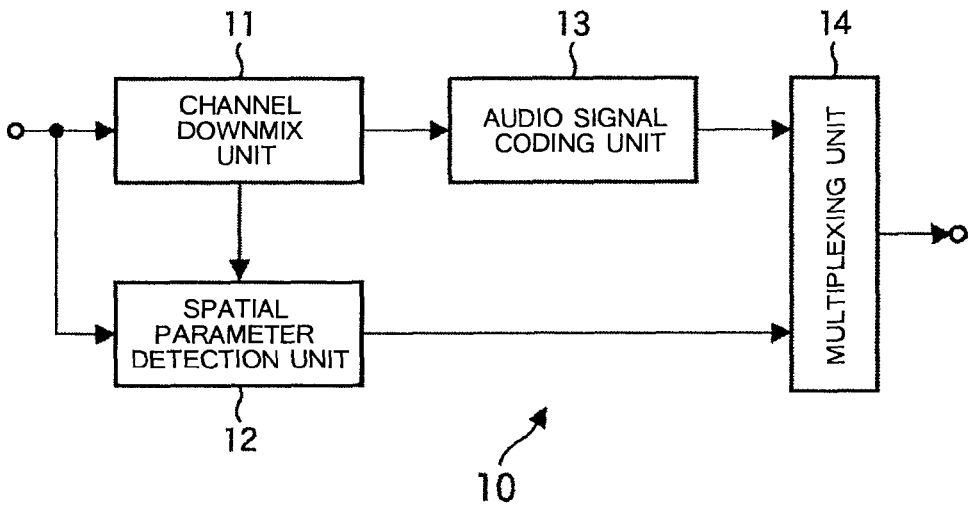
FIG. 1 is a block diagram illustrating a configuration example of a coding apparatus which performs spatial coding.
Figure 2:
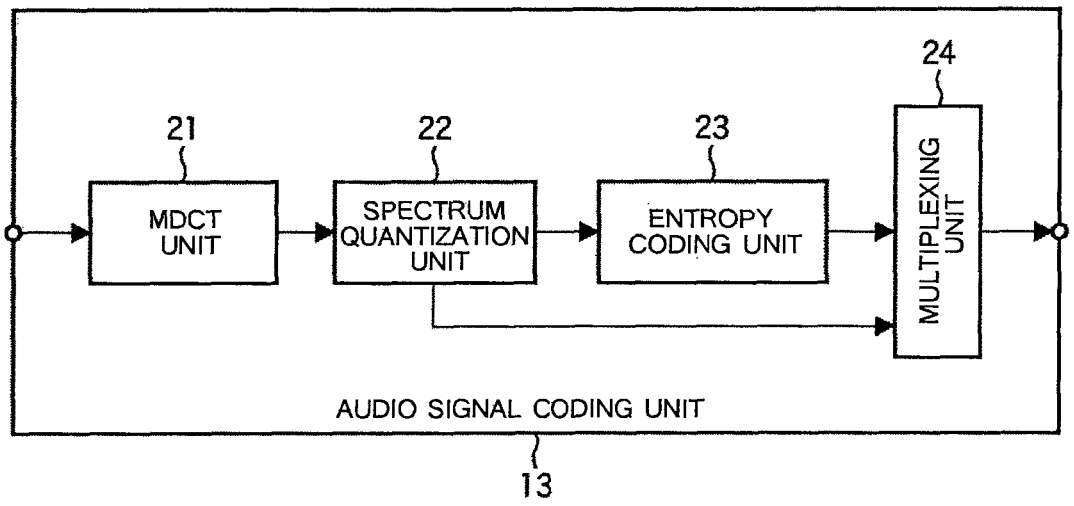
FIG. 2 is a block diagram illustrating a configuration example of an audio signal coding unit in FIG. 1.

The speech processing apparatus 100 decodes, for example, coded data spatially coded by a coding apparatus 10 in FIG. 1 which has an audio signal coding unit 13 in FIG. 2. In this case, the speech processing apparatus 100 generates a signal $X_D'$ which is irrelevant to a monaural signal $X_M$ used upon generation of a stereo signal, using a frequency spectrum coefficient of the monaural signal $X_M$.

More specifically, the inverse multiplexing unit 101 (acquisition unit) of the speech processing apparatus 100 corresponds to the inverse multiplexing unit 41 in FIG. 4 and the inverse multiplexing unit 51 in FIG. 5. That is, the inverse multiplexing unit 101 inversely multiplexes multiplexed coded data supplied from the coding apparatus 10 in FIG. 1, and acquires the coded data and a BC parameter. In addition, although the BC parameter multiplexed on the coded data may be a BC parameter of all frames or may be a BC parameter of a predetermined frame, the BC parameter here refers to the BC parameter of a predetermined frame.

Further, the inverse multiplexing unit 101 inversely multiplexes the coded data, and obtains a quantized and entropy-coded frequency spectrum coefficient and quantization information. Furthermore, the inverse multiplexing unit 101 supplies the quantized and entropy-coded frequency spectrum coefficient, to the entropy decoding unit 52, and supplies the quantization information to the spectrum inverse quantization unit 53. Still further, the inverse multiplexing unit 101 supplies the BC parameter to the generation parameter calculation unit 104.

The uncorrelated frequency-time transform unit 102 generates the monaural signal $X_M$ and the signal $X_D'$ which are two uncorrelated time domain signals, from the frequency spectrum coefficient of the monaural signal $X_M$ obtained as a result of inverse quantization by the spectrum inverse quantization unit 53. Further, the uncorrelated frequency-time transform unit 102 supplies the monaural signal $X_M$ and the signal $X_D'$ to the stereo synthesis unit 103. This uncorrelated frequency-time transform unit 102 will be described in detail with reference to FIGS. 10 and 11 which will be described below.

The stereo synthesis unit 103 (synthesis unit) synthesizes the monaural signal $X_M$ and the signal $X_D'$ supplied from the uncorrelated frequency-time transform unit 102, using generation parameters supplied from the generation parameter calculation unit 104. Further, the stereo synthesis unit 103 outputs a left audio signal $X_L$ and a right audio signal $X_R$ obtained as a result of synthesis as stereo signals. This stereo synthesis unit 103 will be described in detail with reference to FIG. 12 which will be described below.

The generation parameter calculation unit 104 interpolates the BC parameter of a predetermined frame supplied from the inverse multiplexing unit 101, and calculates the BC parameter of each frame. The generation parameter calculation unit 104 generates the generation parameters using the BC parameter of a current processing target frame, and supplies the generation parameters to the stereo synthesis unit 103.

[Detailed Configuration Example of Uncorrelated Frequency-Time Transform Unit]

Figure 10:
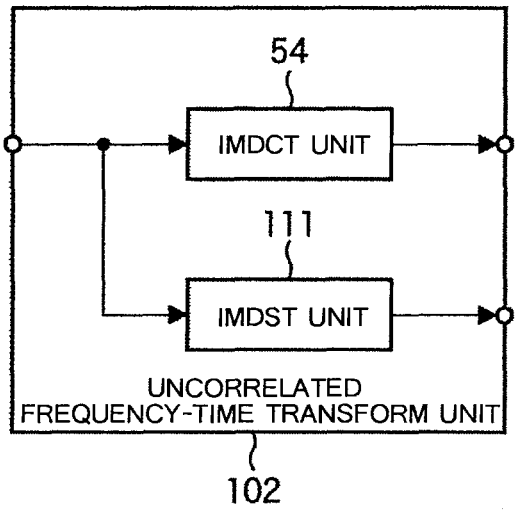
FIG. 10 is a block diagram illustrating a detailed configuration example of an uncorrelated frequency-time transform unit in FIG. 9.

FIG. 10 is a block diagram illustrating a detailed configuration example of an uncorrelated frequency-time transform unit 102 in FIG. 9.

The uncorrelated frequency-time transform unit 102 in FIG. 10 includes an IMDCT unit 54 and an IMDST unit 111.

The IMDCT unit 54 (first transform unit) in FIG. 10 is the same as the IMDCT unit 54 in FIG. 5, and performs IMDCT of the frequency spectrum coefficient of the monaural signal $X_M$ supplied from the spectrum inverse quantization unit 53. Further, the IMDCT unit 54 supplies the resulting monaural signal $X_M$ which is a time domain signal (first time domain signal) to the stereo synthesis unit 103 (FIG. 9).

The IMDST (Inverse Modified Discrete Sine Transform) unit 111 (second transform unit) performs IMDST of the frequency spectrum coefficient of the monaural signal $X_M$ supplied from the vector inverse quantization unit 53. Further, the IMDST unit 111 supplies the resulting signal $X_D'$ which is a time domain signal (second time domain signal) to the stereo synthesis unit 103 (FIG. 9).

As described above, transform performed by the IMDCT unit 54 is inverse cosine transform and transform performed by the IMDST unit 111 is inverse sine transform, and the base of transform performed by the IMDCT unit 54 and the base of transform performed by the IMDST unit 111 are orthogonal. Consequently, it is possible to regard that the monaural signal $X_M$ and the signal $X_D'$ are substantially uncorrelated to each other.

In addition, MDCT, IMDCT and IMDST are defined according to following equations (1) to (3).

[Equation 1]

$$Xc(k) = \sum_{n=0}^{2N-1} w(n) \cdot x(n) \cdot \cos\left[\frac{\pi}{4N}(2n+1+N)(2k+1)\right] \quad (1)$$

$$k = 0, 1, \ldots, N-1$$

[Equation 2]

$$y(n) = \frac{2 \cdot w'(n)}{N} \cdot \sum_{k=0}^{N-1} Xc(k) \cdot \cos\left[\frac{\pi}{4N}(2n+1+N)(2k+1)\right] \quad (2)$$

$$n = 0, 1, \ldots, 2N-1$$

[Equation 3]

$$y(n) = \frac{2 \cdot w'(n)}{N} \cdot \sum_{k=0}^{N-1} Xs(k) \cdot \sin\left[\frac{\pi}{4N}(2n+1+N)(2k+1)\right] \quad (3)$$

$$n = 0, 1, \ldots, 2N-1$$

In equations (1) to (3), x(n) is a time domain signal, w(n) is a transform window, w' (n) is an inverse transform window and y(n) is an inversely transformed signal. Further, Xc(k) is a MDCT coefficient, and Xs(k) is a MDST coefficient.

[Detailed Configuration Example of Uncorrelated Frequency-Time Transform Unit]

Figure 11:
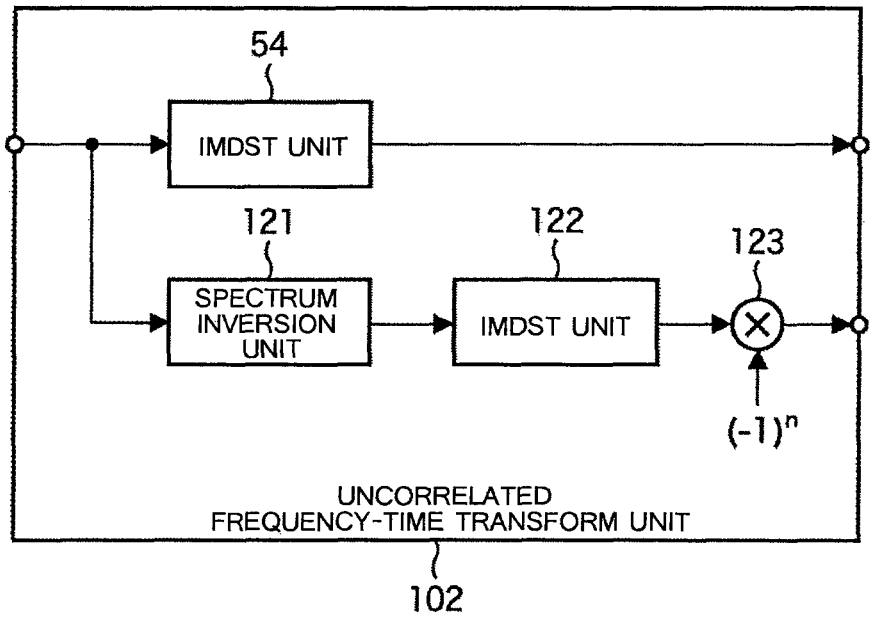
FIG. 11 is a block diagram illustrating another detailed configuration example of the uncorrelated frequency-time transform unit in FIG. 9.

FIG. 11 is a block diagram illustrating another detailed configuration example of the uncorrelated frequency-time transform unit 102 in FIG. 9.

The same configuration illustrated in FIG. 11 as the configuration in FIG. 10 will be assigned same reference numerals. Overlapping description will be adequately skipped.

The configuration of the uncorrelated frequency-time transform unit 102 in FIG. 11 differs from the configuration in FIG. 10 mainly in that a spectrum inversion unit 121, an IMDCT unit 122 and a sign inversion unit 123 are provided instead of the IMDST unit 111.

The spectrum inversion unit 121 of the uncorrelated frequency-time transform unit 102 in FIG. 11 inverts the frequency spectrum coefficient supplied from the spectrum inverse quantization unit 53 such that frequencies are in an inverse order, and supplies the frequency spectrum coefficients to the IMDCT unit 122.

The IMDCT unit 122 performs IMDCT of the frequency spectrum coefficients supplied from the spectrum inversion unit 121, and obtains time domain signals. The IMDCT unit 122 supplies these time domain signals to the sign inversion unit 123.

The sign inversion unit 123 inverts the sign of an odd sample of the time domain signal supplied from the IMDCT unit 122, and obtains the signal $X_D'$.

Meanwhile, when Xs(k) is replaced with Xs(N−k−1) in above equation 3 which defines IMDST, if N is a common multiple of 4, equation 3 can be modified to following equation 4.

[Equation 4]

$$y(n) = \frac{2 \cdot w'(n)}{N} \cdot \sum_{k=0}^{N-1} Xs(N-k-1) \cdot \sin\left[\frac{\pi}{4N}(2n+1+N)(2(N-k-1)+1)\right] = \frac{2 \cdot w'(n)}{N} \cdot (-1)^n \cdot \sum_{k=0}^{N-1} Xs(N-k-1) \cdot \cos\left[\frac{\pi}{4N}(2n+1+N)(2k+1)\right] = (-1)^n \cdot IMDCT[Xs(N-k-1)] \quad (4)$$

Hence, a signal obtained as a result of performing IMDST of the frequency spectrum coefficients from the spectrum inverse quantization unit 53, and a signal obtained as a result of inverting and performing IMDST of the frequency spectrum coefficients such that the frequencies are in an inverse order and inverting the sign of the odd sample are the same signal $X_D'$. That is, the IMDST unit 111 in FIG. 10, and the spectrum inversion unit 121, the IMDCT unit 122 and the sign inversion unit 123 in FIG. 11 are equivalent.

The sign inversion unit 123 supplies the obtained signal $X_D'$ to the stereo synthesis unit 103 in FIG. 9.

As described above, the uncorrelated frequency-time transform unit 102 in FIG. 11 only needs to be provided with an IMDCT unit alone in order to transform a time domain signal into a frequency spectrum coefficient, so that it is possible to reduce manufacturing cost compared to a case where the IMDCT unit and the IMDST unit in FIG. 9 need to be provided.

[Detailed Configuration Example of Stereo Synthesis Unit]

Figure 12:
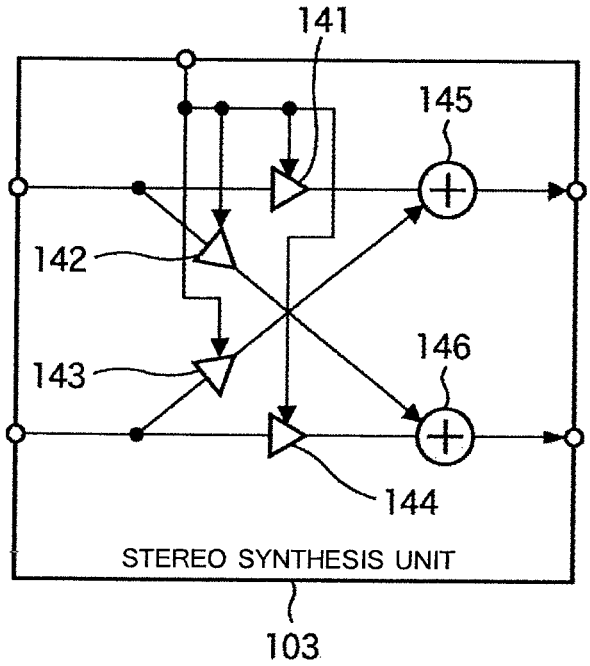
FIG. 12 is a block diagram illustrating a detailed configuration example of a stereo synthesis unit in FIG. 9.

FIG. 12 is a block diagram illustrating a detailed configuration example of the stereo synthesis unit 103 in FIG. 9.

The stereo synthesis unit 103 in FIG. 12 includes multipliers 141 to 144, and an adder 145 and an adder 146.

The multiplier 141 multiplies the monaural signal $X_M$ supplied from the uncorrelated frequency-time transform unit 102, with a coefficient $h_{11}$ which is one of generation parameters supplied from the generation parameter calculation unit 104. The multiplier 141 supplies a resulting multiplication value $h_{11} \times X_M$ to the adder 145.

The multiplier 142 multiplies the monaural signal $X_M$ supplied from the uncorrelated frequency-time transform unit 102, with a coefficient $h_{21}$ which is one of generation parameters supplied from the generation parameter calculation unit 104. The multiplier 141 supplies a resulting multiplication value $h_{21} \times X_M$ to the adder 146.

The multiplier 143 multiplies the signal $X_D'$ supplied from the uncorrelated frequency-time transform unit 102, with a coefficient $h_{12}$ which is one of generation parameters supplied from the generation parameter calculation unit 104. The multiplier 141 supplies a resulting multiplication value $h_{12} \times X_D'$ to the adder 145.

The multiplier 144 multiplies the signal $X_D'$ supplied from the uncorrelated frequency-time transform unit 102, with a coefficient $h_{22}$ which is one of generation parameters supplied from the generation parameter calculation unit 104. The multiplier 141 supplies a resulting multiplication value $h_{22} \times X_D'$ to the adder 146.

The adder 145 adds the multiplication value $h_{11} \times X_M$ supplied from the multiplier 141 and the multiplication value $h_{12} \times X_D'$ supplied from the multiplier 143, and outputs a resulting addition value as the left audio signal $X_L$.

The adder 146 adds the multiplication value $h_{21} \times X_M$ supplied from the multiplier 142 and the multiplication value $h_{22} \times X_D'$ supplied from the multiplier 143, and outputs a resulting addition value obtained as the right audio signal $X_R$.

Figure 13:
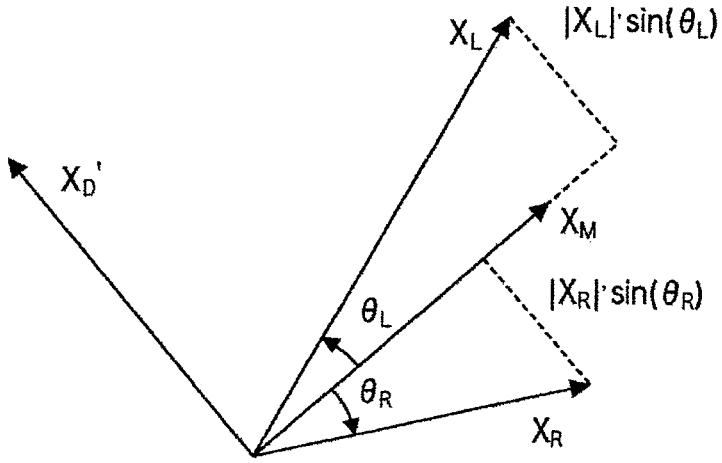
FIG. 13 illustrates a view illustrates a vector of each signal.

As described above, the stereo synthesis unit 103 performs weighted addition using generation parameters as indicated in following equation 5 by using as a vector the monaural signal $X_M$, the signal $X_D'$, the left audio signal $X_L$ and the right audio signal $X_R$ as illustrated in FIG. 13.

[Equation 5]

$$X_L = h_{11} \cdot X_M + h_{12} \cdot X_D'$$

$$X_R = h_{21} \cdot X_M + h_{22} \cdot X_D' \quad (5)$$

In addition, the coefficients $h_{11}$, $h_{12}$, $h_{21}$ and $h_{22}$ are represented by following equation 6.

[Equation 6]

$$h_{11} = g_L \cdot \cos(\theta_L) \quad (6)$$
$$h_{12} = g_L \cdot \sin(\theta_L)$$
$$h_{21} = g_R \cdot \cos(\theta_R)$$
$$h_{22} = g_R \cdot \sin(\theta_R)$$

where

[Equation 7]

$$g_L = \frac{\|X_L\|}{\|X_M\|}, \; g_R = \frac{\|X_R\|}{\|X_M\|} \quad (7)$$

In equation 6, an angle $\theta_L$ is an angle formed between the vector of the left audio signal $X_L$ and the vector of the monaural signal $X_M$, and an angle $\theta_R$ is an angle formed between the vector of the right audio signal $X_R$ and the vector of the monaural signal $X_M$.

Meanwhile, the coefficients $h_{11}$, $h_{12}$, $h_{21}$ and $h_{22}$ are calculated as generation parameters by the generation parameter calculation unit 104. More specifically, the generation parameter calculation unit 104 calculates $g_L$, $g_R$, $\theta_L$ and $\theta_R$ from the BC parameters, and calculates the coefficients $h_{11}$, $h_{12}$, $h_{21}$ and $h_{22}$ from $g_L$, $g_R$, $\theta_L$ and $\theta_R$ as generation parameters. In addition, details of a method of calculating $g_L$, $g_R$, $\theta_L$ and $\theta_R$ from BC parameters are disclosed in, for example, Japanese Patent Application Laid-Open No. 2006-325162.

In addition, for BC parameters, $g_L$, $g_R$, $\theta_L$ and $\theta_R$ can also be used, and compressed coded $g_L$, $g_R$, $\theta_L$ and $\theta_R$ can also be used. Further, for BC parameters, the coefficients $h_{11}$, $h_{12}$, $h_{21}$, and $h_{22}$ can also be directly used, or can also be compressed and coded, and used.

[Description of Processing of Speech Processing Apparatus]

Figure 14:
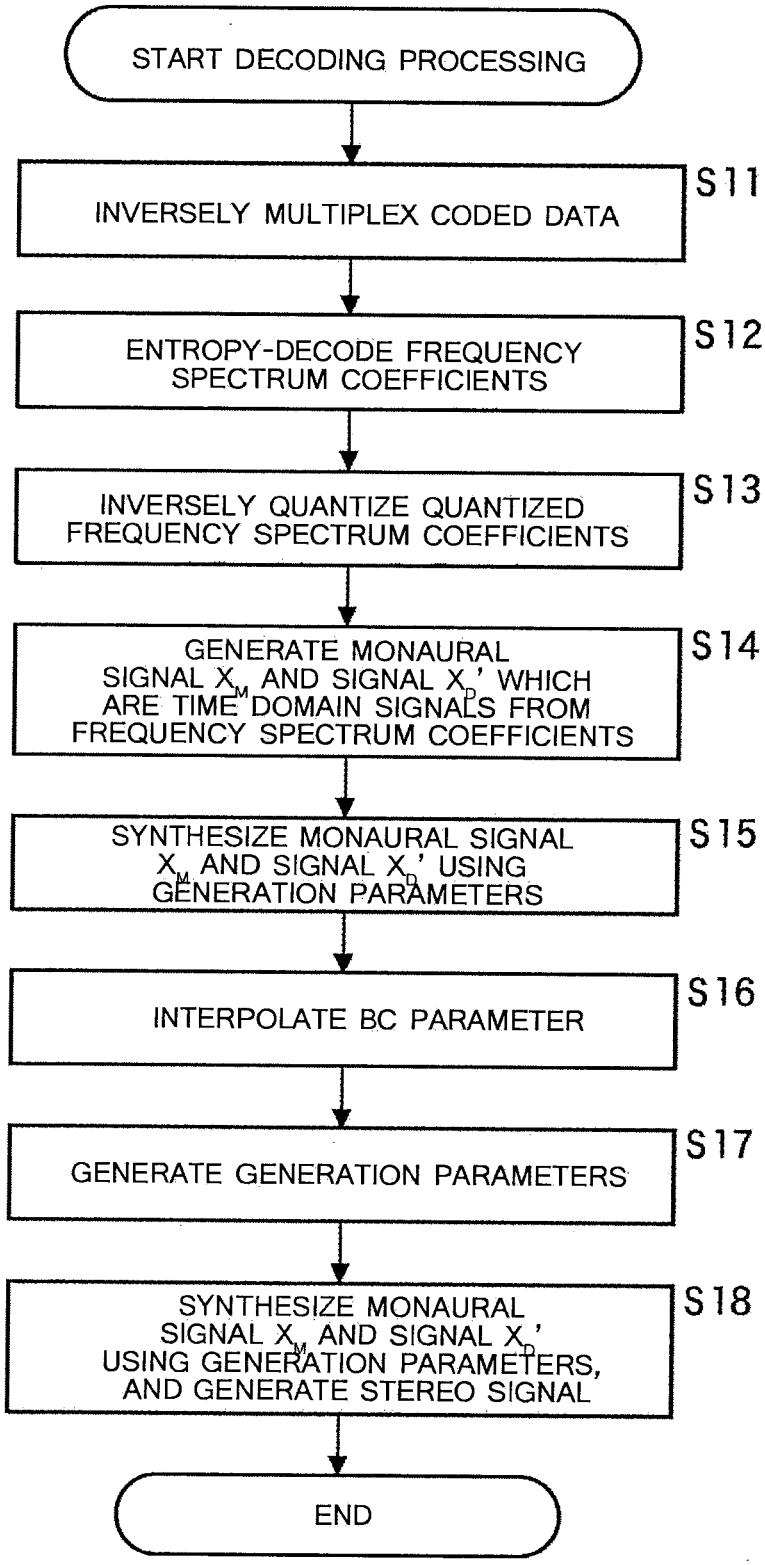
FIG. 14 is a flowchart for describing decoding processing of the speech processing apparatus in FIG. 9.

FIG. 14 is a flowchart for describing decoding processing of the speech processing apparatus 100 in FIG. 9. This decoding processing is started when multiplexed coded data supplied from the coding apparatus 10 in FIG. 1 is input to the speech processing apparatus 100.

In step S11 in FIG. 14, the inverse multiplexing unit 101 inversely multiplexes the multiplexed coded data supplied from the coding apparatus 10 in FIG. 1, and obtains the coded data and the BC parameters. Further, the inverse multiplexing unit 101 further inversely multiplexes this coded data, and the quantized and entropy-coded frequency spectrum coefficients and the quantization information. Furthermore, the inverse multiplexing unit 101 supplies the quantized and entropy-coded frequency spectrum coefficients, to the entropy decoding unit 52, and supplies the quantization information to the spectrum inverse quantization unit 53. Still further, the inverse multiplexing unit 101 supplies the BC parameter to the generation parameter calculation unit 104.

In step S12, the entropy decoding unit 52 performs entropy decoding such as Huffman decoding or arithmetic decoding of the frequency spectrum coefficients supplied from the inverse multiplexing unit 101, and restores the quantized frequency spectrum coefficients. The entropy-decoding unit 52 supplies the frequency spectrum coefficients to the spectrum inverse quantization unit 53.

In step S13, the spectrum inverse quantization unit 53 inversely quantizes the quantized frequency spectrum coefficients supplied from the entropy decoding unit 52 based on the quantization information supplied from the inverse multiplexing unit 101, and restores the frequency spectrum coefficients. Further, the spectrum inverse quantization unit 53 supplies the frequency spectrum coefficients to the uncorrelated frequency-time transform unit 102.

In step S14, the uncorrelated frequency-time transform unit 102 generates the monaural signal $X_M$ and the signal $X_D'$ which are two uncorrelated time domain signals from the frequency spectrum coefficient of the monaural signal $X_M$ obtained as a result of inverse quantization by the spectrum inverse quantization unit 53. Further, the uncorrelated frequency-time transform unit 102 supplies the monaural signal $X_M$ and the signal $X_D'$ to the stereo synthesis unit 103.

In step S15, the stereo synthesis unit 103 synthesizes the monaural signal $X_M$ and the signal $X_D'$ supplied from the uncorrelated frequency-time transform unit 102 using the generation parameters supplied from the generation parameter calculation unit 104.

In step S16, the generation parameter calculation unit 104 interpolates the BC parameter of a predetermined frame supplied from the inverse multiplexing unit 101, and calculates the BC parameter of each frame.

In step S17, the generation parameter calculation unit 104 generates the coefficients $h_{11}$, $h_{12}$, $h_{21}$ and $h_{22}$ as generation parameters using the BC parameter of a current processing target frame, and supplies the generation parameters to the stereo synthesis unit 103.

In step S18, the stereo synthesis unit 103 synthesizes the monaural signal $X_M$ and the signal $X_D'$ supplied from the uncorrelated frequency-time transform unit 102 using the generation parameters supplied from the generation parameter calculation unit 104, and generates a stereo signal. Further, the stereo synthesis unit 103 outputs the stereo signal, and processing ends.

As described above, the speech processing apparatus 100 generates the monaural signal $X_M$ and the signal $X_D'$ by performing two types of transform such that the base is orthogonal to the frequency spectrum coefficient of the monaural signal $X_M$. That is, the speech processing apparatus 100 can generate the signal $X_D'$ using the frequency spectrum coefficient of the monaural signal $X_M$. Consequently, the speech processing apparatus 100 can prevent delay caused by a reverb signal generation unit 71 in FIG. 7 and an increase in the computation amount and buffer resources compared to the conventional decoding apparatus 40 in FIG. 4 which has the audio signal decoding unit 42 in FIG. 5 and the stereo signal generation unit 44 in FIG. 7.

Further, the IMDCT unit 54 of the conventional decoding apparatus 40 can be reutilized as part of the uncorrelated frequency-time transform unit 102, so that it is possible to minimize addition of new functions and prevent an increase in a circuit scale and required resources.

Second Embodiment

Figure 15:
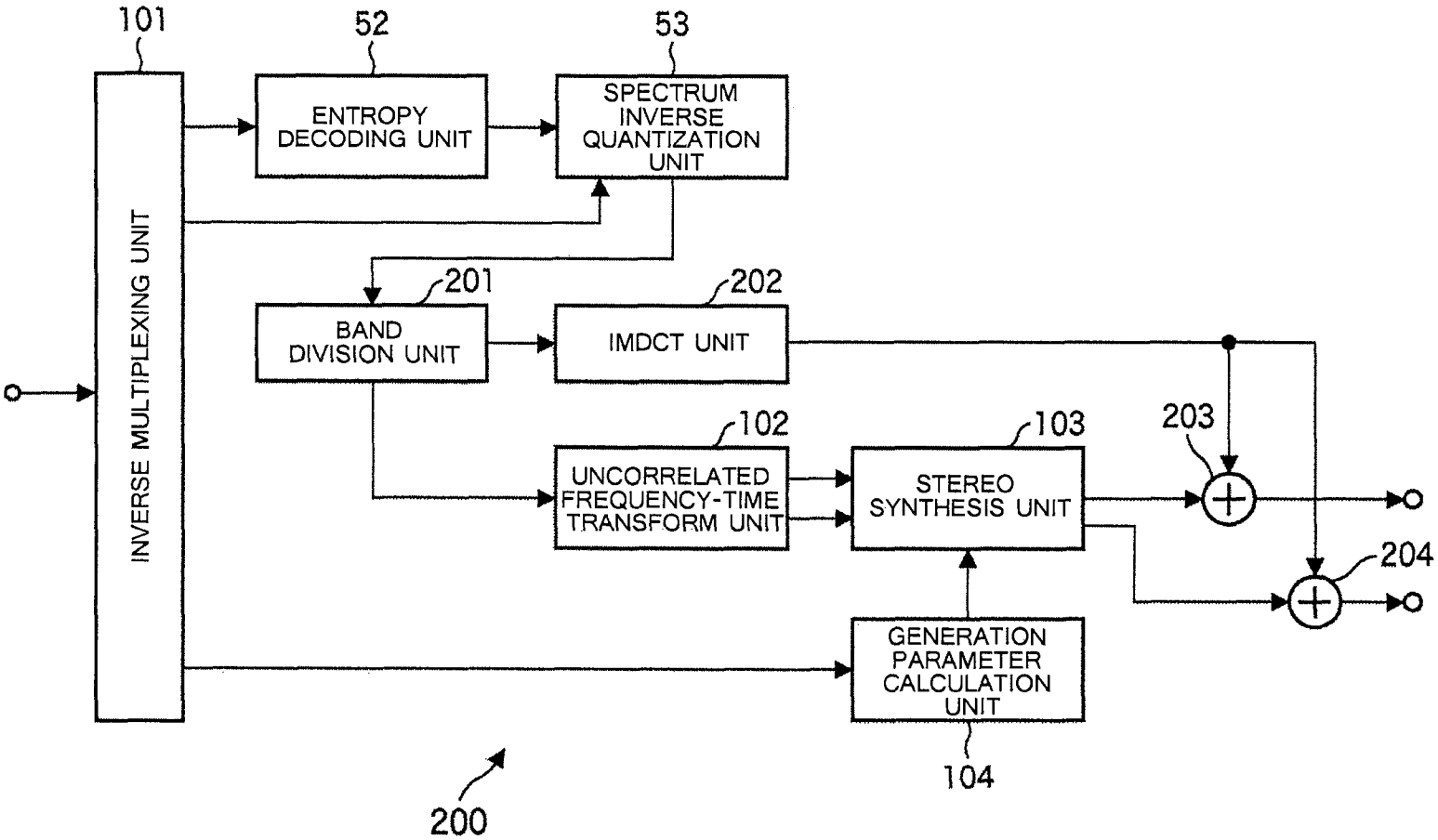
FIG. 15 is a block diagram illustrating a configuration example of a speech processing apparatus to which the present invention is applied according to a second embodiment.

Configuration Example of Speech Processing Apparatus According to Second Embodiment FIG. 15 is a block diagram illustrating a configuration example of a speech processing apparatus to which the present invention is applied according to a second embodiment.

The same configuration illustrated in FIG. 15 as the configuration in FIG. 9 will be assigned the same reference numerals. Overlapping description will be adequately skipped.

The configuration of a speech processing apparatus 200 in FIG. 15 differs from the configuration in FIG. 9 mainly in that a band division unit 201, an IMDCT unit 202, an adder 203 and an adder 204 are additionally provided.

The speech processing apparatus 200 decodes, for example, coded data for which the same spatial coding as in a coding apparatus 10 in FIG. 1 which has an audio signal coding unit 13 in FIG. 2 is performed, and on which the BC parameter of a high band is multiplexed, and stereo-codes only the monaural signal $X_M$ in a high band.

More specifically, the band division unit 201 (division unit) of the speech processing apparatus 200 divides the frequency spectrum coefficient obtained by a spectrum inverse quantization unit 53, into two groups of high band frequency spectrum coefficients and low band frequency spectrum coefficients according to frequencies. Further, the band division unit 201 supplies the low band frequency spectrum coefficients to the IMDCT unit 202, and supplies the high band frequency spectrum coefficients to an uncorrelated frequency-time transform unit 102.

The IMDCT unit 202 (third transform unit) performs IMDCT of the low band frequency spectrum coefficients supplied from the band division unit 201, and obtains a monaural signal $X_M^{low}$ (third time domain signal) which is a low band time domain signal. The IMDCT unit 202 supplies the low band monaural signal $X_M^{low}$ to the adder 203 as a low band left audio signal, and to the adder 204 as the low band right audio signal.

The adder 203 receives an input of a high band left audio signal $X_L^{High}$ obtained as a result of processing the high band frequency spectrum coefficient output from the band division unit 201 in the uncorrelated frequency-time transform unit 102 and the stereo synthesis unit 103. The adder 203 adds the high band left audio signal $X_L^{High}$ and the low band monaural signal $X_M^{low}$ supplied from the IMDCT unit 202 as the low band left audio signal, and generates an entire frequency band left audio signal $X_L$.

The adder 204 receives an input of a high band right audio signal $X_R^{High}$ obtained as a result of processing the high band frequency spectrum coefficient output from the band division unit 201 in the uncorrelated frequency-time transform unit 102 and the stereo synthesis unit 103. The adder 204 adds the high band right audio signal $X_R^{High}$ and the low band monaural signal $X_M^{low}$ supplied from the IMDCT unit 202 as the low band right audio signal, and generates an entire frequency band right audio signal $X_R$.

[Description of Processing of Speech Processing Apparatus]

Figure 16:
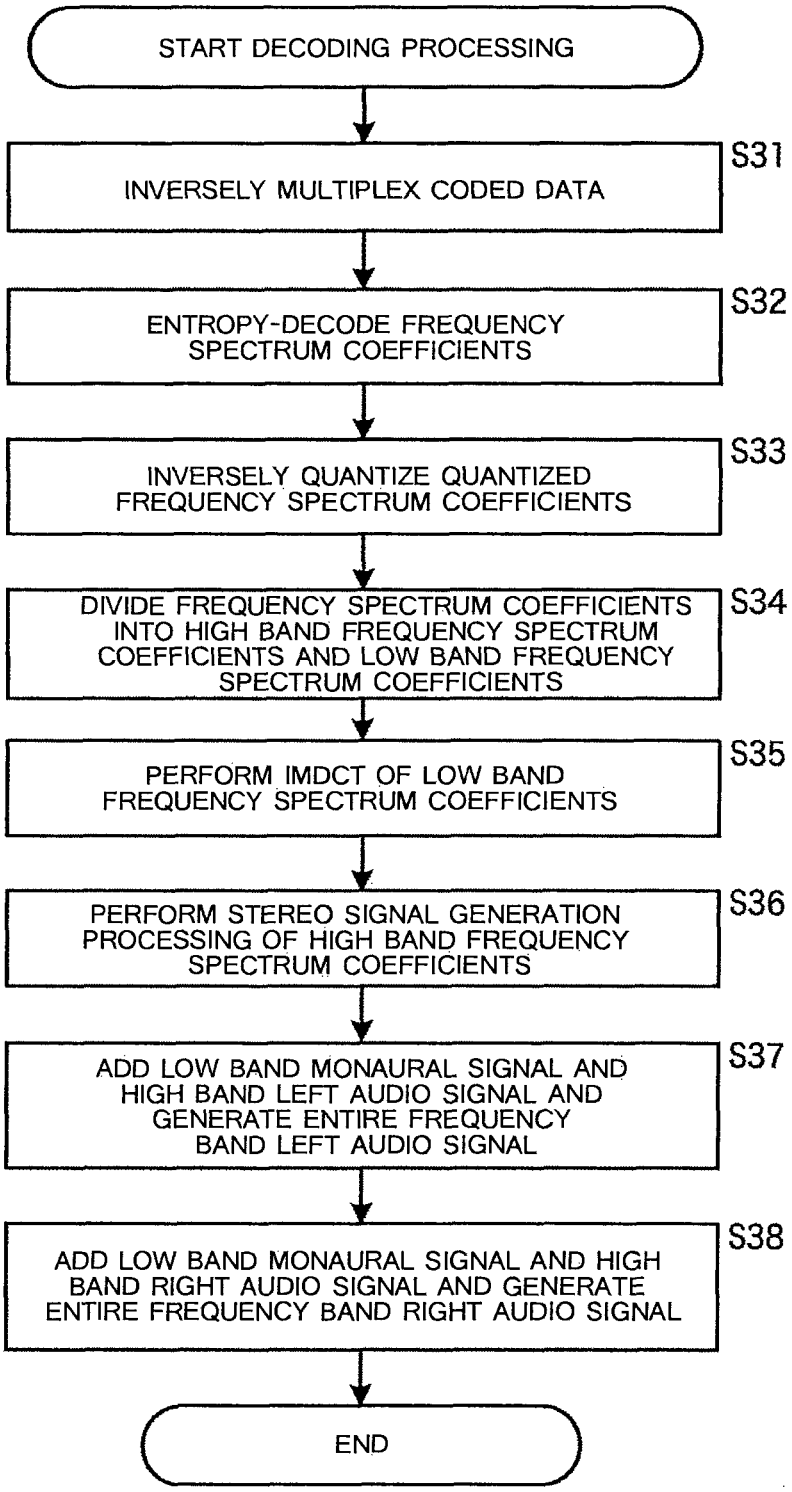
FIG. 16 is a flowchart for describing decoding processing of the speech processing apparatus in FIG. 15.

FIG. 16 is a flowchart for describing decoding processing of the speech processing apparatus 200 in FIG. 15. This decoding processing is started when coded data for which the same spatial coding as in the coding apparatus 10 in FIG. 1 which has the audio signal coding unit 13 in FIG. 2 is performed and on which a BC parameter of a high band is multiplexed is input to the speech processing apparatus 200.

Steps S31 to S33 in FIG. 16 are the same as processing in steps S11 to S13 in FIG. 14, and will not be repeatedly described.

In step S34, the band division unit 201 divides frequency spectrum coefficients obtained by the spectrum inverse quantization unit 53, into two groups of high band frequency spectrum coefficients and low band frequency spectrum coefficients according to frequencies. Further, the band division unit 201 supplies the low band frequency spectrum coefficients to the IMDCT unit 202, and supplies the high band frequency spectrum coefficients to the uncorrelated frequency-time transform unit 102.

In step S35, the IMDCT unit 202 performs IMDCT of the low band frequency spectrum coefficients supplied from the band division unit 201, and obtains the monaural signal $X_M^{low}$ which is a low band time domain signal. The IMDCT unit 202 supplies the low band monaural signal $X_M^{low}$ to the adder 203 as the low band left audio signal, and to the adder 204 as the low band right audio signal.

In step S36, stereo signal generation processing is performed for high band frequency spectrum coefficients supplied from the band division unit 201 by the uncorrelated frequency-time transform unit 102, the stereo synthesis unit 103, and the generation parameter calculation unit 104. More specifically, the uncorrelated frequency-time transform unit 102, the stereo synthesis unit 103 and the generation parameter calculation unit 104 perform processing in steps S14 to S18 in FIG. 14. The resulting high band left audio signal $X_L^{High}$ and high band right audio signal $X_R^{High}$ are input to the adder 203 and the adder 204, respectively.

In step S37, the adder 203 adds the low band monaural signal $X_M^{low}$ supplied from the IMDCT unit 202 as a low band left audio signal and the high band left audio signal $X_L^{High}$ supplied from the uncorrelated frequency-time transform unit 102, and generates an entire frequency band left audio signal $X_L$. Further, the adder 203 outputs the entire frequency band left audio signal $X_L$.

In step S38, the adder 204 adds the low band monaural signal $X_M^{low}$ supplied from the IMDCT unit 202 as the low band right audio signal and the high band right audio signal $X_R^{High}$ supplied from the uncorrelated frequency-time transform unit 102, and generates the entire frequency band right audio signal $X_R$. Further, the adder 204 outputs this entire frequency band right audio signal $X_R$.

As described above, the speech processing apparatus 200 decodes coded data of the entire frequency band monaural signal $X_M$, and stereo-codes only the high band. Consequently, it is possible to prevent sound from being unnatural due to stereo coding of the low band monaural signal $X_M$.

In addition, although, with the speech processing apparatus 200, the band division unit 201 divides frequency spectrum coefficients into high band frequency spectrum coefficients and low band frequency spectrum coefficients, the band division band unit 201 may divide frequency spectrum coefficients into predetermined frequency band frequency spectrum coefficients and other frequency band frequency spectrum coefficients. That is, whether or not stereo coding is performed may be selected depending on whether a frequency band is a predetermined frequency band or other frequency bands instead of whether a frequency band is a low band or a high band.

Third Embodiment

Figure 17:
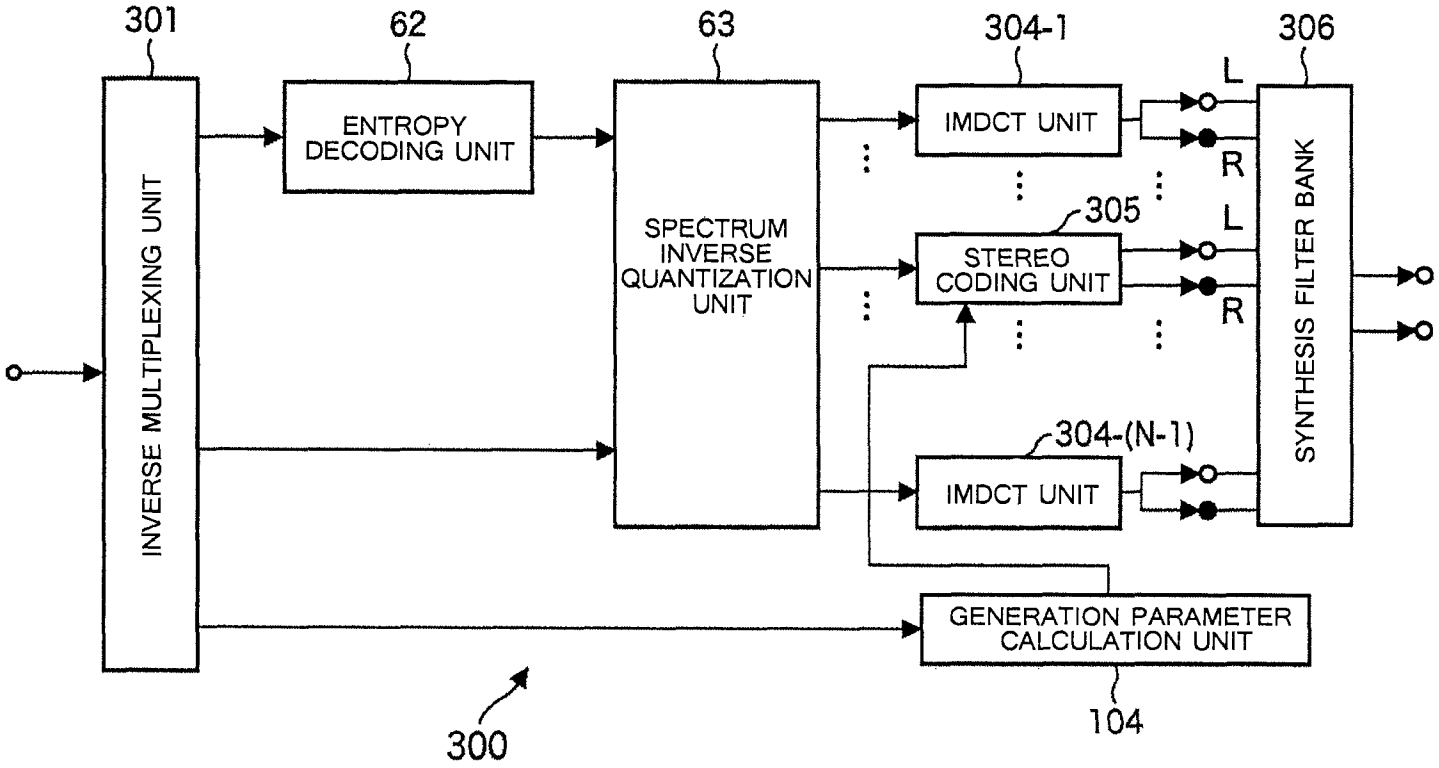
FIG. 17 is a block diagram illustrating a configuration example of a speech processing apparatus to which the present invention is applied according to a third embodiment.

Configuration Example of Speech Processing Apparatus According to Third Embodiment FIG. 17 is a block diagram illustrating a configuration example of a speech processing apparatus to which the present invention is applied according to a third embodiment.

Figure 6:
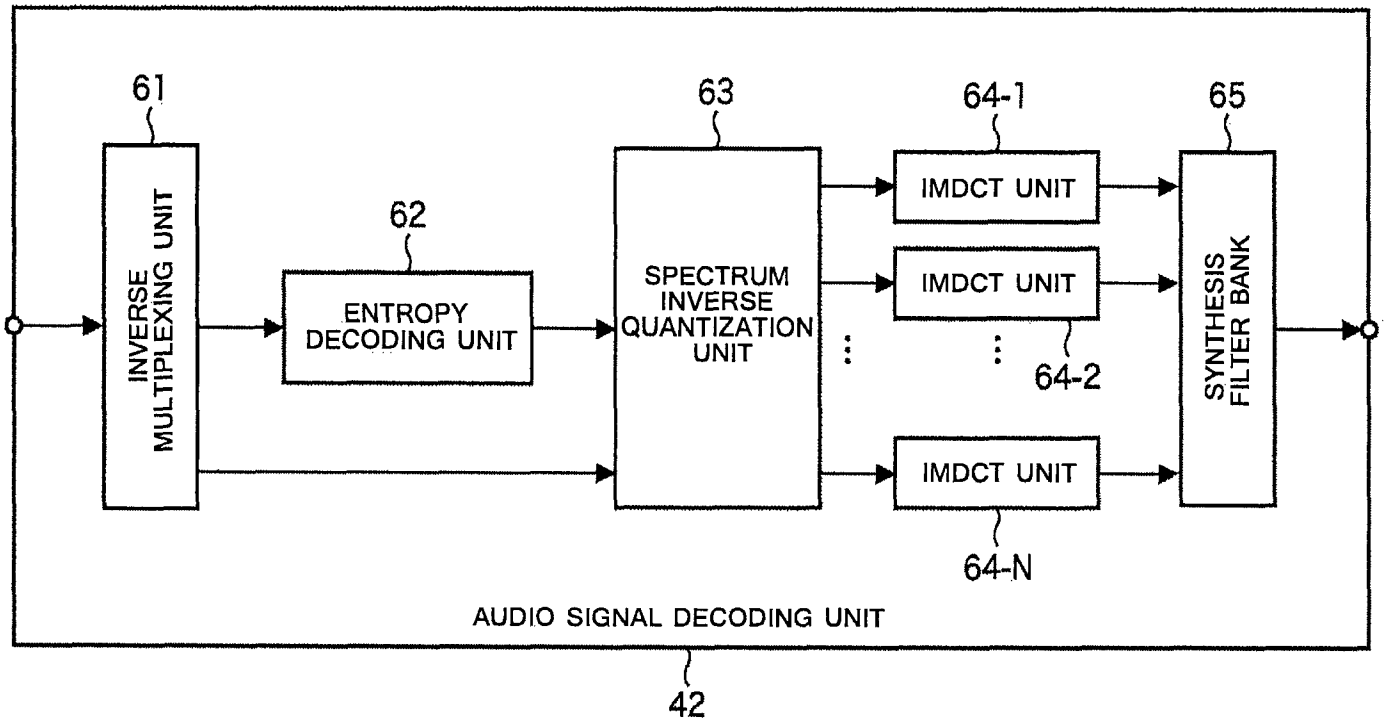
FIG. 6 is a block diagram illustrating another configuration example of the audio signal decoding unit in FIG. 4.

The same configuration illustrated in FIG. 17 as the configurations in FIGS. 4, 6 and 9 will be assigned the same reference numerals. Overlapping description will be adequately skipped.

A configuration of a speech processing apparatus 300 in FIG. 17 differs from a configuration of a decoding apparatus 40 in FIG. 4 which has an audio signal decoding unit 42 in FIG. 6 and a stereo signal generation unit 44 in FIG. 7 mainly in that an inverse multiplexing unit 301 is provided instead of an inverse multiplexing unit 41 and an inverse multiplexing unit 61, IMDCT units 304-1 to 304-(N−1) are provided instead of IMDCT unit 64-1 to IMDCT unit 64-(N−1), a stereo coding unit 305 is provided instead of an IMDCT unit 64-N and a stereo signal generation unit 44 and a generation parameter calculation unit 104 and a synthesis filter bank 306 are provided instead of a generation parameter calculation unit 43 and a synthesis filter bank 65.

Figure 3:
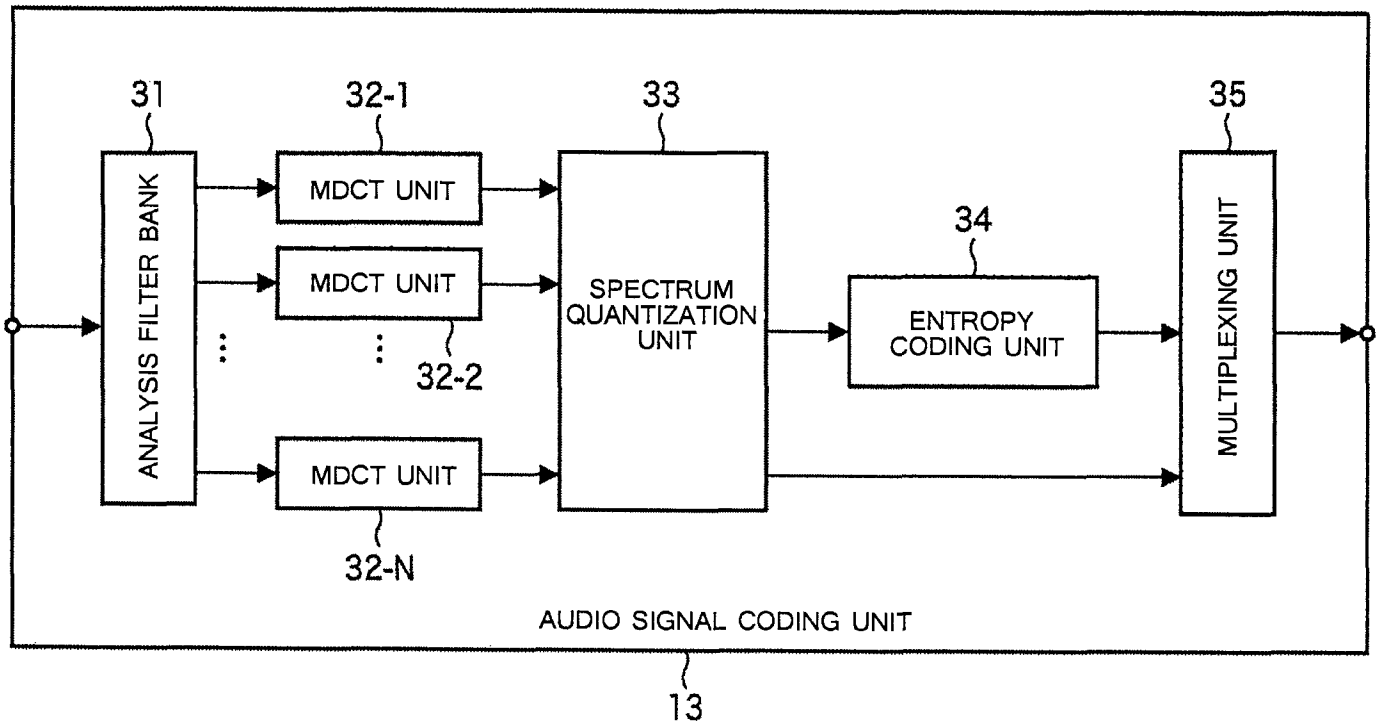
FIG. 3 is a block diagram illustrating another configuration example of the audio signal coding unit in FIG. 1.

The speech processing apparatus 300 in FIG. 17 decodes, for example, coded data for which the same spatial coding as in a coding apparatus 10 in FIG. 1 which has an audio signal coding unit 13 in FIG. 3 is performed, and on which a BC parameter of a predetermined subband signal is multiplexed.

More specifically, the inverse multiplexing unit 301 of the speech processing apparatus 300 corresponds to the inverse multiplexing unit 41 in FIG. 4 and the inverse multiplexing unit 61 in FIG. 6. That is, the inverse multiplexing unit 301 receives an input of coded data for which the same spatial coding as in the coding apparatus 10 in FIG. 1 which has the audio signal coding unit 13 in FIG. 3 is performed, and in which a BC parameter of a predetermined subband signal is multiplexed. The inverse multiplexing unit 301 inversely multiplexes the input coded data, and obtains the coded data and the BC parameter of the predetermined subband signal. Further, the inverse multiplexing unit 301 supplies the BC parameter of the predetermined subband signal to the generation parameter calculation unit 104.

Furthermore, the inverse multiplexing unit 301 inversely multiplexes the coded data, and obtains quantized and entropy-coded frequency spectrum coefficients of N subband signals and quantization information. The inverse multiplexing unit 301 supplies the quantized and entropy-coded frequency spectrum coefficients of the N subband signals to the entropy decoding unit 62, and supplies the quantization information to the spectrum inverse quantization unit 63.

The IMDCT units 304-1 to 304-(N−1) (third transform unit) and the stereo coding unit 305 receive an input of the frequency spectrum coefficients of the N subband signals restored by the spectrum inverse quantization unit 63 one by one.

The IMDCT units 304-1 to 304-(N−1) each perform IMDCT of the input frequency spectrum coefficient, and transform the frequency spectrum coefficient into a subband signal $X_M^i$ (i=1, 2, . . . and N−1) of the monaural signal $X_M$ which is a time domain signal. The IMDCT units 304-1 to 304-(N−1) each supply the subband signal $X_M^i$ to the synthesis filter bank 306 as a left audio signal $X_L^i$ and a right audio signal $X_R^i$.

The stereo coding unit 305 includes an uncorrelated frequency-time transform unit 102 and a stereo synthesis unit 103 in FIG. 9. The stereo coding unit 305 generates a subband signal $X_L^A$ of a left audio signal and a subband signal $X_R^A$ of a right audio signal which are time domain signal, from frequency spectrum coefficients of the predetermined subband signal input from the spectrum inverse quantization unit 63, using the generation parameters generated by the generation parameter calculation unit 104. Further, the stereo coding unit 305 supplies the left subband signal $X_L^A$ and the right subband signal $X_R^A$ to the synthesis filter bank 306.

The synthesis filter bank 306 (addition unit) includes a left synthesis filter bank for synthesizing a subband signal of a left audio signal, and a right synthesis filter bank for synthesizing a subband signal of a right audio signal. The left synthesis filter bank of the synthesis filter bank 306 synthesizes left subband signals $X_L^1$ to $X_L^{N-1}$ from the IMDCT units 304-1 to 304-(N−1), and the left subband signal $X_L^A$ from the stereo coding unit 305. Further, the left synthesis filter bank outputs the entire frequency band left audio signal $X_L$ obtained as a result of synthesis.

Furthermore, the right synthesis filter bank of the synthesis filter bank 306 synthesizes right subband signals $X_R^1$ to $X_R^{N-1}$ from the IMDCT units 304-1 to 304-(N−1), and the right subband signal $X_R^A$ from the stereo coding unit 305. Still further, the right synthesis filter bank outputs the entire frequency band right audio signal $X_R$ obtained as a result of synthesis.

In addition, although the speech processing apparatus 300 in FIG. 17 stereo-codes one subband signal alone, the speech processing apparatus 300 can stereo-codes a plurality of subband signals. Further, a subband signal which is stereo-coded may be dynamically set on a coding side instead of being set in advance. In this case, for example, information for specifying a subband signal which is a stereo coding target is included in a BC parameter.

[Description of Processing of Speech Processing Apparatus]

Figure 18:
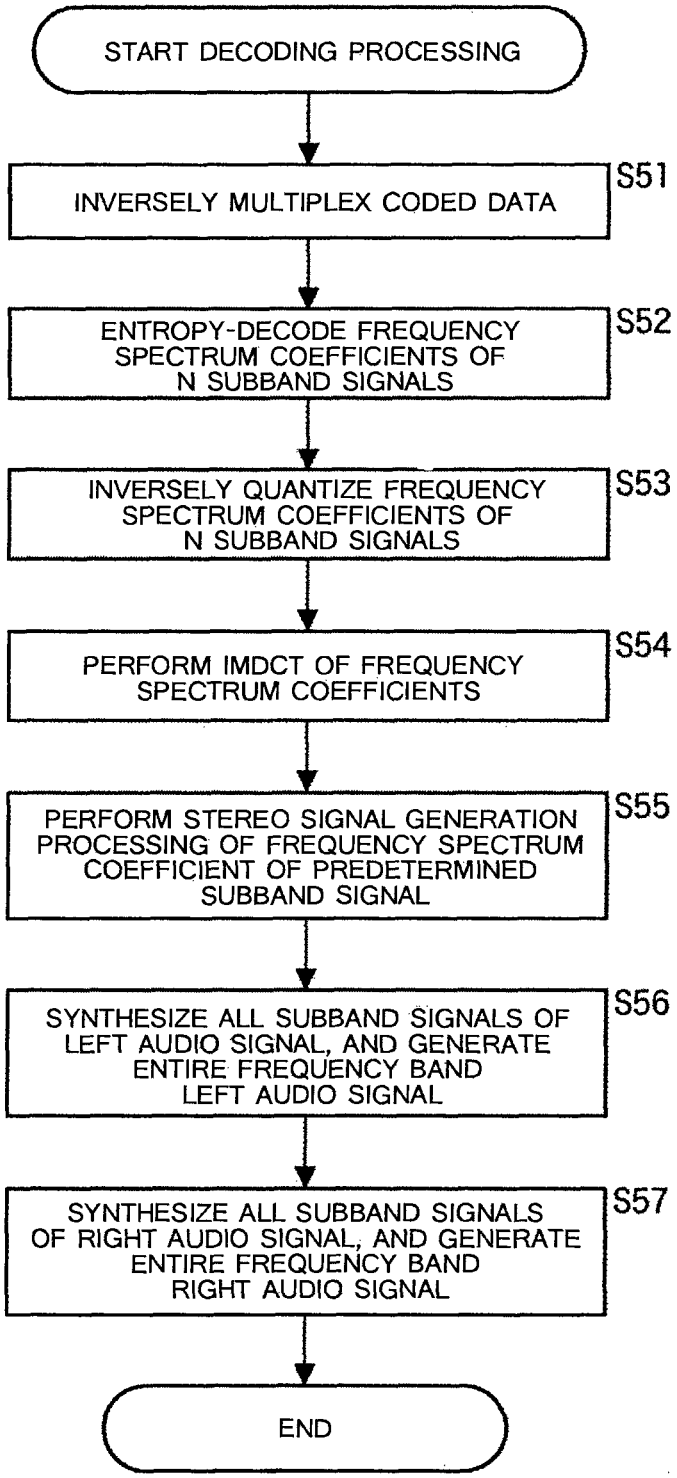
FIG. 18 is a flowchart for describing decoding processing of the speech processing apparatus in FIG. 17.

FIG. 18 is a flowchart for describing decoding processing of the speech processing apparatus 300 in FIG. 17. This decoding processing is started when, for example, coded data for which the same spatial coding as in the coding apparatus 10 in FIG. 1 which has the audio signal coding unit 13 in FIG. 3 is performed, and on which a BC parameter of a predetermined subband signal is multiplexed is input to the speech processing apparatus 300.

In step S51 in FIG. 18, the inverse multiplexing unit 301 inversely multiplexes the input multiplexed coded data, and obtains the coded data and the BC parameter of the predetermined subband signal. Further, the inverse multiplexing unit 301 supplies the BC parameter of the predetermined subband signal to the generation parameter calculation unit 104. Furthermore, the inverse multiplexing unit 301 inversely multiplexes the coded data, and obtains quantized and entropy-coded frequency spectrum coefficients of N subband signals and quantization information. The inverse multiplexing unit 301 supplies the quantized and entropy-coded frequency spectrum coefficients of the N subband signals to the entropy decoding unit 62, and supplies the quantization information to the spectrum inverse quantization unit 63.

In step S52, the entropy decoding unit 62 entropy-decodes the frequency spectrum coefficients of the N subband signals supplied from the inverse multiplexing unit 101, and supplies the frequency spectrum coefficients to the spectrum inverse quantization unit 63.

In step S53, the spectrum inverse quantization unit 63 inversely quantizes the frequency spectrum coefficients of the N subband signals supplied from the entropy decoding unit 62 and obtained as a result of entropy decoding, based on the quantization information supplied from the inverse multiplexing unit 301. Further, the spectrum inverse quantization unit 63 supplies the resulting restored frequency spectrum coefficients of the N subband signals, to the IMDCT units 304-1 to 304-(N−1) and the stereo coding unit 305 one by one.

In step S54, the IMDCT units 304-1 to 304-(N−1) each perform IMDCT of the frequency spectrum coefficient supplied from the spectrum inverse quantization unit 63. Further, the IMDCT units 304-1 to 304-(N−1) each supply the resulting subband signal $X_M^i$ (i=1, 2, . . . and N−1) of a monaural signal to the synthesis filter bank 306 as the subband signal $X_L^i$ of the left audio signal and the subband signal $X_L^i$ of the right audio signal.

In step S55, the stereo coding unit 305 performs stereo signal generation processing of the frequency spectrum coefficient of a predetermined subband signal supplied from the spectrum inverse quantization unit 63, using the generation parameters supplied from the generation parameter calculation unit 104. Further, the stereo coding unit 305 supplies the resulting subband signal $X_L^A$ of the left audio signal and subband signal $X_R^A$ of the right audio signal which are time domain signals, to the synthesis filter bank 306.

In step S56, the left synthesis filter bank of the synthesis filter bank 306 synthesizes all subband signals of left audio signals supplied from the IMDCT units 304-1 to 304-(N−1) and the stereo coding unit 305, and generates the entire frequency band left audio signal $X_L$. Further, the left synthesis filter bank outputs this entire frequency band left audio signal $X_L$.

In step S57, the right synthesis filter bank of the synthesis filter bank 306 synthesizes all subband signals of right audio signals supplied from the IMDCT units 304-1 to 304-(N−1) and the stereo coding unit 305, and generates the entire frequency band right audio signal $X_R$. Further, the right synthesis filter bank outputs this entire frequency band right audio signal $X_R$.

Fourth Embodiment

Figure 19:
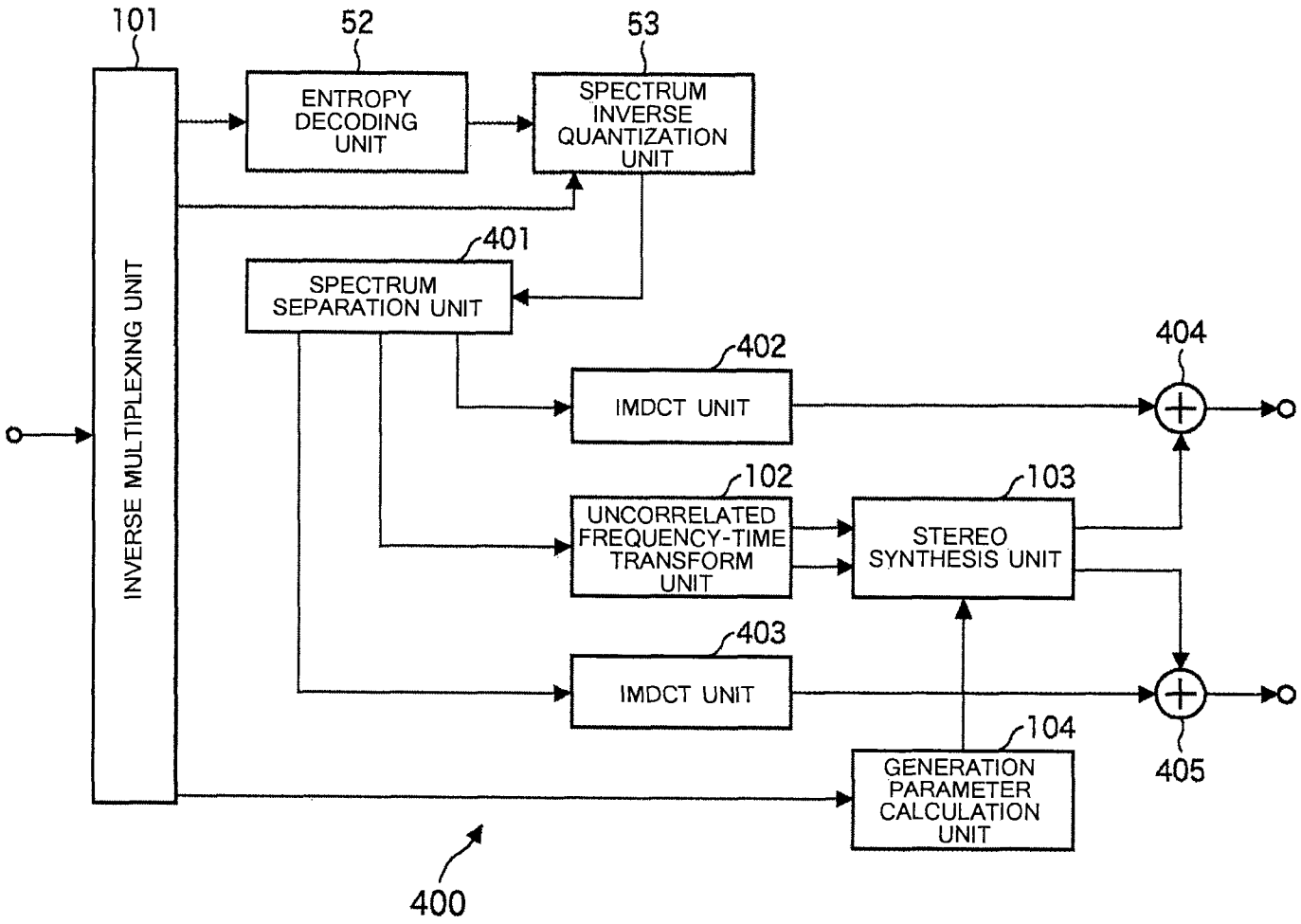
FIG. 19 is a block diagram illustrating a configuration example of a speech processing apparatus to which the present invention is applied according to a fourth embodiment.

Configuration Example of Speech Processing Apparatus According to Fourth Embodiment FIG. 19 is a block diagram illustrating a configuration example of a speech processing apparatus to which the present invention is applied according to a fourth embodiment.

The same configuration illustrated in FIG. 19 as the configuration in FIG. 15 will be assigned the same reference numerals. Overlapping description will be adequately skipped.

The configuration of a speech processing apparatus 400 in FIG. 19 differs from the configuration in FIG. 15 mainly in that a spectrum separation unit 401 is provided instead of a band division unit 201, IMDCTs 402 and 403 are provided instead of an IMDCT unit 202, and an adder 404 and an adder 405 are provided instead of an adder 203 and an adder 204.

The speech processing apparatus 400 decodes coded data for which intensity coding is performed, and on which a BC parameter at a frequency equal to or more than an intensity start frequency Fis is multiplexed instead of a conventional level ratio of inter-channel frequency spectrum coefficients.

That is, the coded data decoded by the speech processing apparatus 400 is generated by a coding apparatus which detects the BC parameter by, for example, downmixing a coding target stereo signal to a monaural signal $X_M$ and extracting the resulting monaural signal $X_M$ and a component at a frequency equal to or more than the intensity start frequency Fis of the coding target stereo signal by means of, for example, a bypass filter.

The spectrum separation unit 401 (separation unit) of the speech processing apparatus 400 obtains frequency spectrum coefficients restored by a spectrum inverse quantization unit 53. The spectrum separation unit 401 separates this frequency spectrum coefficient into a frequency spectrum coefficient of a stereo signal at a frequency lower than the intensity start frequency Fis and a frequency spectrum coefficient of a monaural signal $X_M^{high}$ at a frequency equal to or more than the intensity start frequency Fis. The spectrum separation unit 401 supplies the frequency spectrum coefficient of the left audio signal $X_L^{low}$ of the stereo signal at a frequency lower than the intensity start frequency Fis, to the IMDCT unit 402, and supplies the frequency spectrum coefficient of the right audio signal $X_R^{low}$ to the IMDCT unit 403. Further, the spectrum separation unit 401 supplies the frequency spectrum coefficient of the monaural signal $X_M^{high}$ to an uncorrelated frequency-time transform unit 102.

The IMDCT unit 402 (third transform unit) performs IMDCT of the frequency spectrum coefficient of the left audio signal $X_L^{low}$ supplied from the spectrum separation unit 401, and supplies the resulting left audio signal $X_L^{low}$ to the adder 404.

The IMDCT unit 403 (third transform unit) performs IMDCT of the frequency spectrum coefficient of the right audio signal $X_R^{low}$ supplied from the spectrum separation unit 401, and supplies the resulting right audio signal $X_R^{low}$ to the adder 405.

The adder 404 (addition unit) adds the left audio signal $X_L^{high}$ which is generated by the stereo synthesis unit 103 and which is a time domain signal at a frequency equal to or more than an intensity start frequency Fis, and the left audio signal $X_L^{low}$ supplied from the IMDCT unit 402. The adder 404 outputs the resulting audio signal as the entire frequency band left audio signal $X_L$.

The adder 405 (addition unit) adds the right audio signal $X_R^{high}$ which is generated by the stereo synthesis unit 103 and which is a time domain signal at a frequency equal to or more than the intensity start frequency Fis, and the right audio signal $X_R^{low}$ supplied from the IMDCT unit 402. The adder 405 outputs the resulting audio signal as the entire frequency band right audio signal $X_R$.

As described above, the speech processing apparatus 400 stereo-codes a component of the frequency equal to or more than the intensity start frequency Fis monaural-coded by intensity coding, using the BC parameter multiplexed on intensity-coded data. Consequently, it is possible to restore a stereophonic effect of the component of the frequency equal to or more than the intensity start frequency Fis compared to an intensity decoding apparatus which performs stereo-coding using a conventional level ratio of inter-channel frequency spectrum coefficients.

[Description of Processing of Speech Processing Apparatus]

Figure 20:
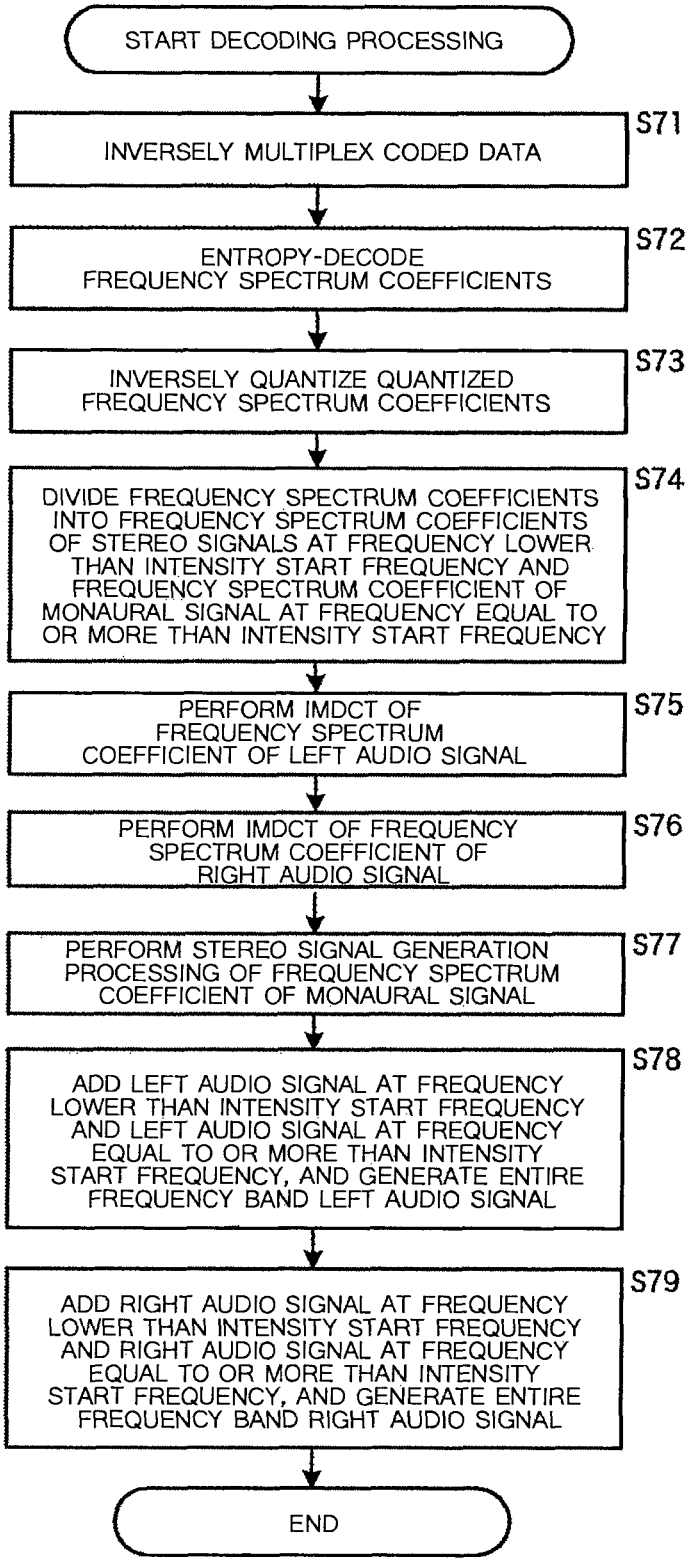
FIG. 20 is a flowchart for describing decoding processing of the speech processing apparatus in FIG. 19.

FIG. 20 is a flowchart for describing decoding processing of the speech processing apparatus 400 in FIG. 19. This decoding processing is started when, for example, coded data which is intensity-coded and on which the BC parameter of the frequency equal to or more than the intensity start frequency Fis is multiplexed is input.

Processing in steps S71 to S73 in FIG. 20 are the same as the processing in steps S31 to S33 in FIG. 16, and therefore will not be described.

In step S74, the spectrum separation unit 401 separates the frequency spectrum coefficients restored by the spectrum inverse quantization unit 53 into frequency spectrum coefficients of stereo signals at a frequency lower than the intensity start frequency Fis and the frequency spectrum coefficient of the monaural signal $X_M^{high}$ at a frequency equal to or more than the intensity start frequency Fis. The spectrum separation unit 401 supplies the frequency spectrum coefficient of the left audio signal $X_L^{low}$ of the stereo signal at a frequency lower than the intensity start frequency Fis, to the IMDCT unit 402, and the frequency spectrum coefficient of the right audio signal $X_R^{low}$ to the IMDCT unit 403. Further, the spectrum separation unit 401 supplies the frequency spectrum coefficient of the monaural signal $X_M^{high}$ to the uncorrelated frequency-time transform unit 102.

In step S75, the IMDCT unit 402 performs IMDCT of the frequency spectrum coefficient of the left audio signal $X_L^{low}$ supplied from the spectrum separation unit 401. Further, the IMDCT unit 402 supplies the resulting left audio signal $X_L^{low}$ to the adder 404.

In step S76, the IMDCT unit 403 performs IMDCT of the frequency spectrum coefficient of the right audio signal $X_R^{low}$ supplied from the spectrum separation unit 401. Further, the IMDCT unit 403 supplies the resulting right audio signal $X_R^{low}$ to the adder 405.

In step S77, the uncorrelated frequency-time transform unit 102, the stereo synthesis unit 103 and the generation parameter calculation unit 104 perform stereo signal generation processing of the frequency spectrum coefficient of the monaural signal $X_M^{high}$ from the spectrum separation unit 401. The resulting left audio signal $X_L^{high}$ which is a time domain signal is supplied to the adder 404, and the right audio signal $X_R^{high}$ is supplied to the adder 405.

In step S78, the adder 404 adds the left audio signal $X_L^{low}$ at a frequency lower than the intensity start frequency Fis from the IMDCT unit 402 and the left audio signal $X_L^{high}$ at a frequency equal to or more than the intensity start frequency Fis from the stereo synthesis unit 103, and generates the entire frequency band left audio signal $X_L$. Further, the adder 404 outputs this left audio signal $X_L$.

In step S79, the adder 405 adds the right audio signal $X_R^{low}$ at a frequency lower than the intensity start frequency Fis from the IMDCT unit 403 and the right audio signal $X_R^{high}$ at a frequency equal to or more than the intensity start frequency Fis from the stereo synthesis unit 103, and generates the entire frequency band right audio signal $X_R$. Further, the adder 405 outputs this right audio signal $X_R$.

In addition, although, with the above description, a speech processing apparatus 100 (200, 300 and 400) decodes coded data which is time-frequency transformed by MDCT, and therefore IMDCT is performed upon frequency-time transform, IMDST is performed upon frequency-time transform when coded data which is time-frequency transformed by MDST is decoded.

Further, although, with the above description, the uncorrelated time-frequency transform unit 102 uses IMDCT transform and IMDST transform where bases are orthogonal to each other, other lapped orthogonal transform such as sine transform or cosine transform may be used.

[Description of Computer to which Present Invention is Applied]

Next, a series of the above processing can be executed by hardware or by software. When a series of the processing are executed by software, a program configuring this software is installed to, for example, a general-purpose computer.

Figure 21:
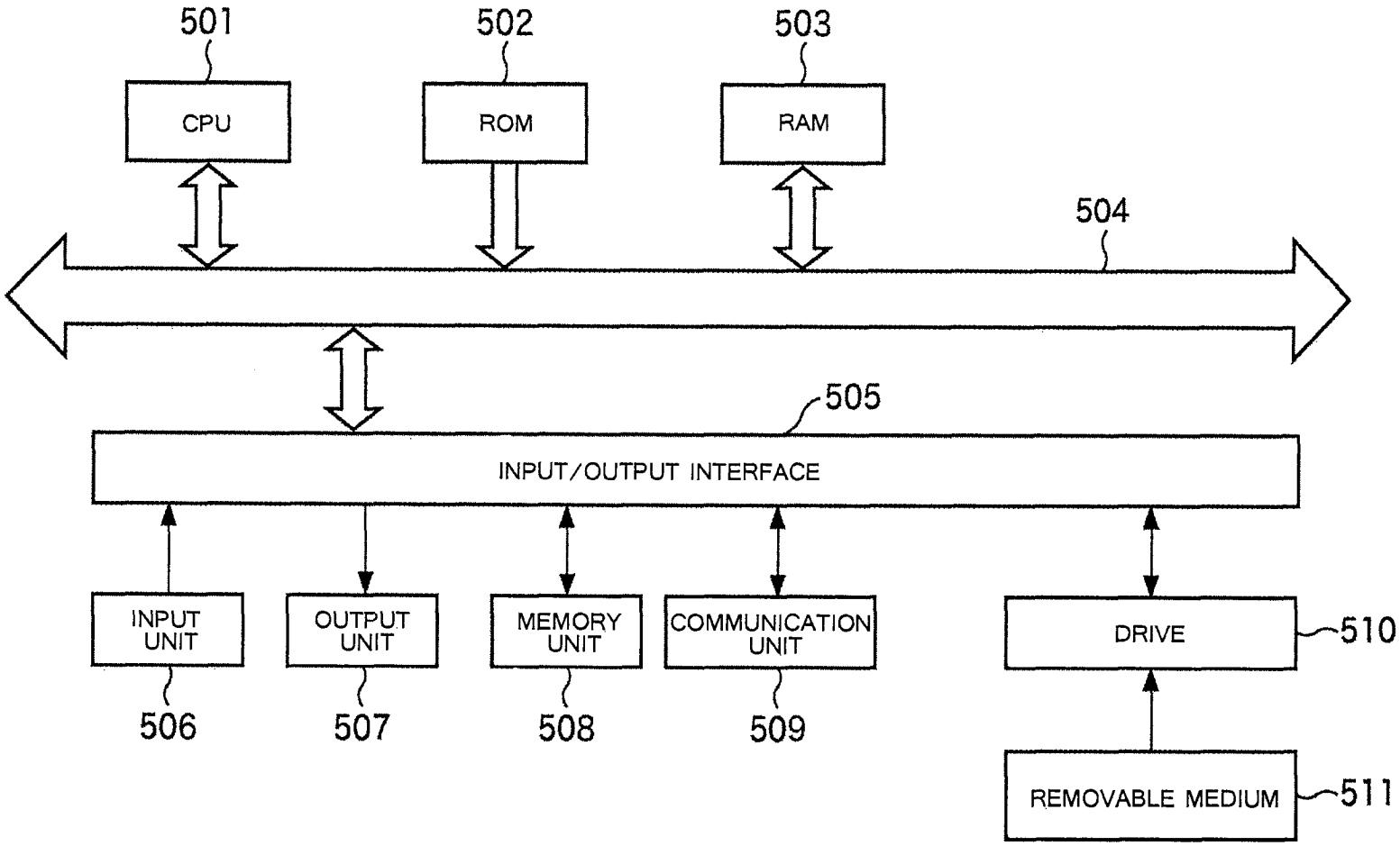
FIG. 21 is a view illustrating a configuration example of a computer according to an embodiment.

FIG. 21 illustrates a configuration example of a computer in which a program for executing a series of the above processing are installed according to an embodiment.

The program can be recorded in advance in a memory unit 508 or a ROM (Read Only Memory) 502 which is a recording medium built in the computer.

Alternatively, the program can be stored (recorded) in a removable media 511. This removable media 511 can be provided as so-called package software. Meanwhile, the removable media 511 includes, for example, a flexible disc, a CD-ROM (Compact Disc Read Only Memory), a MO (Magneto Optical) disc, a DVD (Digital Versatile Disc), a magnetic disc and a semiconductor memory.

In addition, the program can be installed to a computer from the above removable media 511 through a drive 510, and, in addition, may be downloaded to a computer through a communication network or a broadcasting network or installed in the built-in memory unit 508. That is, the program can be wirelessly transferred, for example, from a download site to a computer through a digital satellite broadcasting satellite, or can be transferred to a computer by way of a wire through a network such as LAN (Local Area Network) or Internet.

The computer has a built-in CPU (Central Processing Unit) 501, and the CPU 501 is connected with an input/output interface 505 through a bus 504.

The CPU 501 executes the program stored in the ROM 502 according to a command when receiving an input of the command according to, for example, a user's operation of an input unit 506 through the input/output interface 505. Alternatively, the CPU 501 loads the program stored in the memory unit 508 to a RAM (Random Access Memory) 503 and executes the program.

Thus, the CPU 501 executes processing according to the above flowchart or processing executed by the configuration in the above block diagram. Further, the CPU 501 outputs this processing result from an output unit 507 through the input/output interface 505, transmits the processing result from a communication unit 509 or records the processing result in the memory unit 508.

In addition, the input unit 506 includes a keyboard, a mouse or a microphone. Further, the output unit 507 includes a LCD (Liquid Crystal Display) or speakers.

Meanwhile, in this description, processing executed by the computer according to the program does not necessarily need to be executed in a chronological order disclosed as a flowchart. That is, the processing executed by the computer according to the program include processing (such as parallel processing or processing by an object) executed in parallel or individually.

Further, the program may be processed by one computer (processor) or processed in a distributed manner by a plurality of computers. Furthermore, the program may be transferred to a distant computer and executed.

The present invention is applicable to a pseudo stereo coding technique for audio signals.

The embodiments of the present invention are by no means limited to the above embodiments, and can be variously modified within a scope which does not deviate from the spirit of the present invention.

REFERENCE SIGNS LIST

54 IMDCT unit
100 Speech processing apparatus
101 Inverse multiplexing unit
103 Stereo synthesis unit
111 IMDST unit
121 Spectrum inversion unit
122 IMDCT unit

123 Sign inversion unit
200 Speech processing apparatus
201 Band division unit
202 IMDCT unit
203, 204 Adder
300 Speech processing apparatus
301 Inverse multiplexing unit
304-1 to 304-N IMDCT unit
305 Stereo coding unit
306 Synthesis filter bank
400 Speech processing apparatus
401 Spectrum separation unit
402, 403 IMDCT unit
404, 405 Adder

The invention claimed is:

1. A speech processing apparatus comprising:

an acquisition unit which acquires frequency domain coefficients of speech, signals of channels which are generated from speech signals which are speech time domain signals of a plurality of channels, and the number of which is less than a plurality of channels, and a parameter representing a relationship between the plurality of channels;

a first transform unit which transforms the frequency domain coefficients acquired by the acquisition unit, into first time domain signals;

a second transform unit which transforms the frequency domain coefficients acquired by the acquisition unit, into second time domain signals; and a synthesis unit which generates the speech signals of the plurality of channels by synthesizing the first time domain signals and the second time domain signals using the parameter, wherein a base of transform performed by the first transform unit and a base of transform performed by the second transform unit are orthogonal.

2. The speech processing apparatus according to claim 1, further comprising:

a division unit which divides the frequency domain coefficients acquired by the acquisition unit, into a plurality of groups according to a frequency;

a third transform unit which transforms the frequency domain coefficients divided into a first group among the plurality of groups, into third time domain signals; and an addition unit which adds the third time domain signals which are speech signals of respective channels in a frequency band of the first group and the speech signals of the plurality of channels generated by the synthesis unit per channel, and generates the speech signals of the plurality of channels in an entire frequency band, wherein the acquisition unit acquires the frequency domain coefficients and the parameter in a frequency band of a second group which is a group other than the first group, the first transform unit transforms the frequency domain coefficients divided into the second group, into the first time domain signals, the second transform unit transforms the frequency domain coefficients divided into the second group, into the second time domain signals, and the synthesis unit generates the speech signals of the plurality of channels in the frequency band of the second group by synthesizing the first time domain signals and the second time domain signals using the parameter.

3. A speech processing apparatus according to claim 1, further comprising:

a third transform unit which transforms frequency domain coefficients of a first group among the frequency domain coefficients acquired by the acquisition unit and divided into a plurality of groups according to a frequency, into third time domain signals; and an addition unit which adds the third time domain signals which are speech signals of respective channels in the frequency band of the first group and the speech signals of the plurality of channels generated by the synthesis unit per channel, and generates the speech signals of the plurality of channels in an entire frequency band, wherein the acquisition unit acquires the frequency domain coefficients of each group and the parameter of a frequency band of a second group which is a group other than the first group among the plurality of groups, the first trans form unit transforms the frequency domain coefficients divided into the second group, into the first time domain signals, the second transform unit transforms the frequency domain coefficients divided into the second group, into the second time domain signals, and the synthesis unit generates the speech signals of the plurality of channels in a frequency band of the second group by synthesizing the first time domain signals and the second time domain signals using the parameter.

4. The speech processing apparatus according to claim 1, wherein the frequency domain coefficients are generated from frequency domain coefficients of the speech signals of the plurality of channels.

5. A speech processing apparatus according to claim 4, further comprising:

a separation unit which separates the frequency domain coefficients in a predetermined frequency band acquired by the acquisition unit, and the frequency domain coefficients of the speech signals of a plurality of channels in a frequency band other than the predetermined frequency band;

a third transform unit which transforms the frequency domain coefficients of the speech signals of the plurality of channels separated by the separation unit, into third time domain signals of the plurality of channels; and an addition unit which adds the third time domain signals of the plurality of channels which are the speech signals of the plurality of channels in the frequency band other than the predetermined frequency band and the speech signals of the plurality of channels generated by the synthesis unit, and generates the speech signals of the plurality of channels in an entire frequency band, wherein the acquisition unit acquires the frequency domain coefficients in the predetermined frequency band, the frequency domain coefficients of the speech signals of the plurality of channels in the frequency band other than the predetermined frequency band, and the parameter in the predetermined frequency band, the first transform unit transforms the frequency domain coefficients in the predetermined frequency band separated by the separation unit, into the first time domain signals, the second transform unit transforms the frequency domain coefficients in the predetermined frequency band separated by the separation unit, into the second time domain signals, and the synthesis unit generates the speech signals of the plurality of channels in the predetermined frequency band by synthesizing the first time domain signals and the second time domain signals using the parameter.

6. The speech processing apparatus according to any one of claims 1 to 5, wherein the frequency domain coefficients are MDCT (Modified Discrete Cosine Transform) coefficients, transform performed by the first transform unit is IMDCT (Inverse Modified Discrete Cosine Transform), and transform performed by the second transform unit is IMDST (Inverse Modified Discrete Sine Transform).

7. The speech processing apparatus according to any one of claims 1 to 5, wherein the second transform unit comprises:

a spectrum inversion unit which inverts the frequency domain coefficients such that frequencies are in an inverse order;

an IMDCT unit which obtains time domain signals by performing IMDCT (Inverse Modified Discrete Cosine Transform) of the frequency domain coefficients obtained as a result of inversion by the spectrum inversion unit; and a sign inversion unit which inverts a sign of each sample of the time domain signals obtained by the IMDCT unit every other sign, and the frequency domain coefficients are MDCT (Modified Discrete Cosine Transform) coefficients, and transform performed by the first transform unit is IMDCT.

8. A speech signal processing method to be performed by a speech processing apparatus, the method comprising:

an acquisition step of acquiring frequency domain coefficients of speech signals of channels which are generated from speech signals which are speech time domain signals of a plurality of channels, and the number of which is less than a plurality of channels, and a parameter representing a relationship between the plurality of channels;

a first transform step of transforming the frequency domain coefficients acquired by processing in the acquisition step, into first time domain signals;

a second transform step of transforming the frequency domain coefficients acquired by processing in the acquisition step, into second time domain signals; and a synthesis step of generating the speech signals of the plurality of channels by synthesizing the first time domain signals and the second time domain signals using the parameter, wherein a base of transform in processing in the first transform step and a base of transform in processing in the second transform step are orthogonal.

9. A non-transitory computer-readable storage medium storing a program which, when executed by a computer, causes the computer to perform:

an acquisition step of acquiring frequency domain coefficients of speech signals of channels which are generated from speech signals which are speech time domain signals of a plurality of channels, and the number of which is less than a plurality of channels, and a parameter representing a relationship between the plurality of channels;

a first transform step of transforming the frequency domain coefficients acquired by processing in the acquisition step, into first time domain signals;

a second transform step of transforming the frequency domain coefficients acquired by processing in the acquisition step, into second time domain signals; and a synthesis step of generating the speech signals of the plurality of channels by synthesizing the first time domain signals and the second time domain signals using the parameter, wherein a base of transform in processing in the first transform step and a base of transform in processing in the second transform step are orthogonal.

* * * * *